US010322498B2

(12) United States Patent
Ishikawa et al.

(10) Patent No.: US 10,322,498 B2
(45) Date of Patent: Jun. 18, 2019

(54) ELECTRIC POWER TOOL

(71) Applicant: MAKITA CORPORATION, Anjo-shi, Aichi (JP)

(72) Inventors: Goshi Ishikawa, Anjo (JP); Ryunosuke Kumagai, Anjo (JP); Takuya Kusakawa, Anjo (JP); Yoshitaka Ichikawa, Anjo (JP); Tokuo Hirabayashi, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 562 days.

(21) Appl. No.: 14/885,448

(22) Filed: Oct. 16, 2015

(65) Prior Publication Data

US 2016/0107297 A1 Apr. 21, 2016

(30) Foreign Application Priority Data

Oct. 20, 2014 (JP) ..... 2014-213970
Aug. 28, 2015 (JP) ..... 2015-169406

(51) Int. Cl.
*B25B 21/00* (2006.01)
*B25B 21/02* (2006.01)
*B25B 23/18* (2006.01)

(52) U.S. Cl.
CPC ..... *B25B 21/008* (2013.01); *B25B 21/02* (2013.01); *B25B 21/026* (2013.01); *B25B 23/18* (2013.01)

(58) Field of Classification Search
CPC ..... B25B 21/008; B25B 21/02; B25B 21/026; B25B 23/18
USPC ..... 173/176, 179, 93.5, 5, 181, 11
See application file for complete search history.

(56) References Cited

U.S. PATENT DOCUMENTS 5,549,169 A * 8/1996 Matsumura ..... B23P 19/06 173/176
2004/0144552 A1 7/2004 Suzuki et al.
2006/0185869 A1* 8/2006 Arimura ..... B25B 23/1475 173/176

(Continued)

FOREIGN PATENT DOCUMENTS

DE 102014211891 A1 12/2015
EP 1695794 A2 8/2006

(Continued)

OTHER PUBLICATIONS

Nov. 24, 2017 Office Action issued in Geman Patent Application No. 10 2015 013 532.5.

(Continued)

*Primary Examiner* — Andrew M Tecco
*Assistant Examiner* — Nicholas E Igbokwe
(74) *Attorney, Agent, or Firm* — Oliff PLC

(57) ABSTRACT

An electric power tool in one aspect of the present disclosure comprises a motor, a hitting mechanism, a hitting detector, and a control unit. The control unit is configured to set a control amount of the motor so that the motor rotates at a lower speed than a speed in the target rotation state during an initial driving period, and switch the control amount to a final control amount corresponding to the target rotation state when the initial driving period elapses. The initial driving period is a period from when generation of a hitting force is detected by the hitting detector until a predetermined first time period elapses, after the motor is started driven.

17 Claims, 15 Drawing Sheets

(56) References Cited

U.S. PATENT DOCUMENTS

| | | | | |
|---|---|---|---|---|
| 2011/0056715 | A1* | 3/2011 | Vanko | B25F 5/00 173/176 |
| 2011/0148332 | A1* | 6/2011 | Kawano | B25F 5/00 318/244 |
| 2011/0315417 | A1 | 12/2011 | Matsunaga et al. | |
| 2013/0062086 | A1 | 3/2013 | Ito et al. | |
| 2013/0068491 | A1* | 3/2013 | Kusakawa | B25B 21/00 173/176 |

FOREIGN PATENT DOCUMENTS

| | | | |
|---|---|---|---|
| JP | 2010-207951 | A | 9/2010 |
| JP | 2013-252579 | A | 12/2013 |
| WO | 2011/152136 | A1 | 12/2011 |
| WO | 2015/193022 | A1 | 12/2015 |

OTHER PUBLICATIONS

Feb. 5, 2019 Office Action issued in Japanese Patent Application No. 2015-169406.

* cited by examiner

ELECTRIC POWER TOOL

CROSS-REFERENCE TO RELATED APPLICATIONS

This application claims the benefit of Japanese Patent Application No. 2014-213970 filed Oct. 20, 2014 and No. 2015-169406 filed Aug. 28, 2015 in the Japan Patent Office, and the entire disclosures thereof are incorporated herein by reference.

BACKGROUND

The present disclosure relates to an electric power tool configured to generate a hitting force in a rotation direction of a tool element and transmit the hitting force to the tool element.

The electric power tool disclosed in Unexamined Japanese Patent Application Publication No. 2010-207951 is provided with a hitting mechanism comprising a hammer that rotates in response to a rotational force of a motor and an anvil that rotates in response to a rotational force of the hammer. The hitting mechanism is configured such that, when a torque of a predetermined value or more is externally applied to the anvil, the hammer is disengaged from the anvil to run idle, and then hits the anvil in the rotation direction.

According to this electric power tool, when the motor is rotated in a forward direction to fix a target object such as a screw and a nut to a plate or a bolt, it is possible to tighten the target object firmly due to the hitting of the anvil by the hammer. When loosening the tightening of the target object, the motor is rotated in a reverse direction to the direction at the time of the tightening so as to let the hammer hit the anvil. Thereby, it is possible to easily loosen the tightening of the target object.

SUMMARY

In the electric power tool described above, for example, when a user operates an operation unit such as a trigger switch with a maximum operation amount, the motor is driven with a maximum driving power of 100% driving duty thereby to rotate the motor (and a tool bit) at high speed.

However, in this way, if the motor is driven at high speed immediately after started to be driven, the tool bit such as a driver bit may be easily disengaged from a target object such as a screw. Tightening by the hitting mechanism may not be satisfactorily carried out.

For example, in a case of fixing a long screw to a workpiece by the electric power tool described above, if hitting is started in a state that the long screw is not sufficiently inserted to the workpiece, the tool bit may be disengaged from a screw head by rapid change of load and deflection of the long screw at the time when hitting is started. The workpiece, tool bit, screw head and the like may sometimes be damaged.

In one aspect of the present disclosure, it is desirable to be able to provide an electric power tool that can inhibit a tool element from being disengaged from a target object after hitting occurs.

The electric power tool in one aspect of the present disclosure comprises a motor, a hitting mechanism, a hitting detector, and a control unit. The motor generates a rotational force for rotating a tool element attached to the electric power tool. The hitting mechanism, when a torque of a predetermined value or more is applied to the tool element, generates a hitting force in a rotation direction of the tool element, and transmits the hitting force to the tool element.

The hitting detector detects generation of the hitting force by the hitting mechanism. The control unit controls driving of the motor such that the motor is placed into a target rotation state. The control unit further sets a control amount of the motor such that the motor rotates at a lower speed than a speed in the target rotation state during an initial driving period. When the initial driving period elapses, the control unit switches the control amount to a final control amount corresponding to the target rotation state.

The initial driving period is a period from when generation of the hitting force by the hitting detector is detected until a predetermined first time period elapses, after the motor is started driven.

According to this electric power tool, even if a rotation state requiring a maximum driving power of the motor is set as the target rotation state, increase in rotation speed of the motor is inhibited until hitting by the hitting mechanism is initiated and a predetermined period elapses, after the motor is started driven.

Thus, during the initial driving period, the hitting force by the hitting mechanism is reduced. It is possible to inhibit the tool element from being disengaged from a target object such as a long screw when hitting by the hitting mechanism is initiated in a state that the object is not sufficiently inserted to a workpiece.

In addition, if the initial driving period is set such that hitting by the hitting mechanism is performed during that period, it is possible to firmly fix an object such as a long screw to the workpiece by the hitting performed during the initial driving period.

When the initial driving period elapses, the control amount of the motor is switched to the final control amount and the rotation of the motor is increased. Thus, the hitting force by the hitting mechanism becomes stronger, and it is possible to inhibit time required for tightening an object such as a long screw to the workpiece from being prolonged.

The control unit may be configured to determine that the initial driving period has elapsed when generation of the hitting force is detected a predetermined number of times by the hitting detector, after the motor is started driven. In addition, the control unit may be configured to determine that the initial driving period has elapsed when a predetermined time elapses since generation of the hitting force has been detected by the hitting detector, after the motor is started driven.

In other words, the initial driving period until switching of the control amount to the final control amount after the motor is started driven may be set by the number of times of hitting by the hitting mechanism, or may be set by the time elapsed after the hitting is initiated by the hitting mechanism.

The control unit may be configured to drive the motor in so-called open loop control in which the driving power when the motor is driven (for example, conduction current to the motor, driving duty ratio at the time of PWM control, and the like) is simply controlled.

In addition, the electric power tool may comprise a speed detector configured to detect a rotation speed of the motor. In this case, the control unit may be configured to drive the motor in rotation control (so-called feedback control) in which the control amount is set such that the rotation speed detected by the speed detector becomes equal to a target rotation speed.

In this case, switching of the control amount of the motor along with the lapse of the initial driving period may be implemented by switching the target rotation speed in the feedback control to be higher than the speed during the initial driving period.

That is, when controlling the driving of the motor in the feedback control, the control amount for controlling the driving power of the motor is set in accordance with a deviation between the rotation speed of the motor and the target rotation speed.

Therefore, if the target rotation speed during the initial driving period is set to be low speed and the target rotation speed after the lapse of the initial driving period is switched to be higher, the above effect can be exhibited even if the control unit is already configured to drive the motor in the feedback control.

The electric power tool may comprise an operation unit that is configured to select an operation mode from among a plurality of operation modes different in the target rotation state, that is, for example, high speed and low speed, or high speed, medium speed and low speed, etc.

In this case, the control unit may be configured to set the control amount such that the rotation speed of the motor becomes high speed or low speed, or high speed, medium speed or low speed, depending on the operation mode selected via the operation unit.

In addition, the control unit may be configured to set the control amount of the motor such that the motor rotates at a lower speed than the speed in the target rotation state during the initial driving period, and to switch the control amount of the motor to the final control amount corresponding to the target rotation state after the lapse of the initial driving period, for each operation mode.

In this case, if the operation mode selected via the operation unit is a low speed mode in which the motor rotates at a lower speed than a rotation speed for the operation mode not selected, the control unit may be configured to start driving the motor with the final control amount corresponding to the target rotation state for the low speed mode.

That is, the control unit may be configured so as not to switch the control amount after the motor is started driven in the low speed mode, and to start driving of the motor with the final control amount corresponding to the target rotation state (in this case, low speed).

In this way, the control amount during the initial driving period is set to be the control amount for driving the motor at a lower speed than the speed in the target rotation state, in the low speed mode. Thus, it is possible to inhibit the rotation speed of the motor before occurrence of hitting from becoming too low, and to inhibit time required for tightening of the object from being prolonged.

The control unit may be configured to gradually change the control amount up to the final control amount so that the rotation speed of the motor is gradually increased upon switching the control amount of the motor to the final control amount after the lapse of the initial driving period.

In this case, since the rotation speed of the motor is gradually increased, it is possible to inhibit the tool element from being disengaged from the object by the switching of the control amount.

When the operation unit for setting the operation mode is provided, the control unit may gradually change the control amount up to the final control amount at a different rate of change for each of the plurality of operation modes, so that the rotation speed of the motor is gradually increased upon switching the control amount of the motor to the final control amount.

In this case, when the operation mode is a low speed mode in which the motor is rotated at low speed, the control unit may increase a rate of change of the control amount upon gradually changing the control amount up to the final control amount, as compared with a case in which the operation mode is a high speed mode in which the motor rotates at high speed.

In this way, when the selected operation mode is the low speed mode, the rotation state of the motor after the lapse of the initial driving period can be more quickly shifted to the target rotation state. It is possible to inhibit time required for tightening the object in the low speed mode from being prolonged.

Conversely, when the selected operation mode is the low speed mode, the control unit may reduce a rate of change of the control amount upon gradually changing the control amount up to the final control amount, as compared with a case in which the selected operation mode is the high speed mode.

In this way, when the selected operation mode is the low speed mode, the rotation state of the motor after the lapse of the initial driving period can be slowly shifted to the target rotation state. It is possible to inhibit the tool element from being disengaged from the object by switching of the control amount in the low speed mode.

Upon gradually changing the control amount of the motor up to the final control amount after the lapse of the initial driving period, the control unit may vary the control amount at a constant rate of change (in other words, in stages at a rate of a predetermined amount in a predetermined time).

In this case, the control unit may reduce the rate of change of the control amount after the lapse of the initial driving period, as compared to an initial rate of change that is a rate of change of the control amount at the time of increasing the rotation speed of the motor when the motor is started driven.

In this way, the rate of change of the control amount after the lapse of the initial driving period becomes less than the rate of change of the control amount when the motor is started driven so that switching of the control amount to the final control amount can be slowly carried out. Therefore, even in this way, it is possible to inhibit the tool element from being disengaged from the object due to switching of the control amount after the lapse of the initial driving period.

Also, upon gradually changing the control amount of the motor up to the final control amount after the lapse of the initial driving period, the control unit may vary the control amount so that a rate of change of the control amount is gradually increased in accordance with the elapsed time.

In this way, after the lapse of the initial driving period, the rotation speed of the motor is increased in an arched shape. Immediately after the lapse of the initial driving period, it is possible to inhibit the increase in the rotation speed of the motor and inhibit the tool element from being disengaged from the object.

Moreover, since the rotation speed of the motor increases in an arched shape with time elapsed from the initial driving period, it is possible to inhibit time required for the tightening of the object from being prolonged.

Also, in a case where the rate of change of the control amount is varied to gradually increase after the lapse of the initial driving period as such, the control unit may reduce the rate of change of the control amount as compared to the initial rate of change in a predetermined second period after the lapse of the initial driving period.

In this case, the control unit may increase the rate of change of the control amount with time as compared to the initial rate of change, after the lapse of the second period. As a result, it is possible to inhibit time required for the tightening of the object from being prolonged, while inhibiting the tool element from being disengaged from the object after the lapse of the initial driving period.

The control unit may control the rotation state of the motor after the lapse of the initial driving period to the target rotation state by increasing a duty ratio of a PWM signal used to drive and control the motor as the control amount of the motor.

In addition, the control unit may control the rotation state of the motor after the lapse of the initial driving period to the target rotation state by increasing a conduction angle at the time when the motor is driven as the control amount of the motor.

In this case, the control unit may, for example, fix the duty ratio of the PWM signal used in driving the motor to 100% to control timings of starting and ending conduction to a motor coil.

As a result, it is not necessary for the control unit to switch a switching element for conduction control at high speed. As compared to a case where the control unit is adapted to control the duty ratio of the PWM signal, it is possible to reduce heat generation of the switching element.

The hitting mechanism may be configured in any way so as to generate a hitting force in a rotation direction of a tool element and transmit the hitting force to the tool element when a torque of a predetermined value or more is applied to the tool element.

For example, the hitting mechanism may comprise a hammer configured to rotate by a rotational force generated by the motor, an anvil configured to rotate in response to the rotation of the hammer, and an attachment portion for attaching the tool element to the anvil.

In this case, the hitting mechanism may be configured such that, when a torque of a predetermined value or more is applied to the anvil, the hammer is disengaged from the anvil to run idle and hits the anvil in the rotation direction of the tool element.

BRIEF DESCRIPTION OF THE DRAWINGS

Hereinafter, with reference to the accompanying drawings, a description of the present disclosure will be given by way of example in which.

DETAILED DESCRIPTION OF THE PREFERRED EMBODIMENTS

In this exemplary embodiment, description will be given of a case where the present disclosure is applied to a rechargeable impact driver (hereinafter referred to as "driver") 1 which is one example of an electric power tool.

Figure 1:
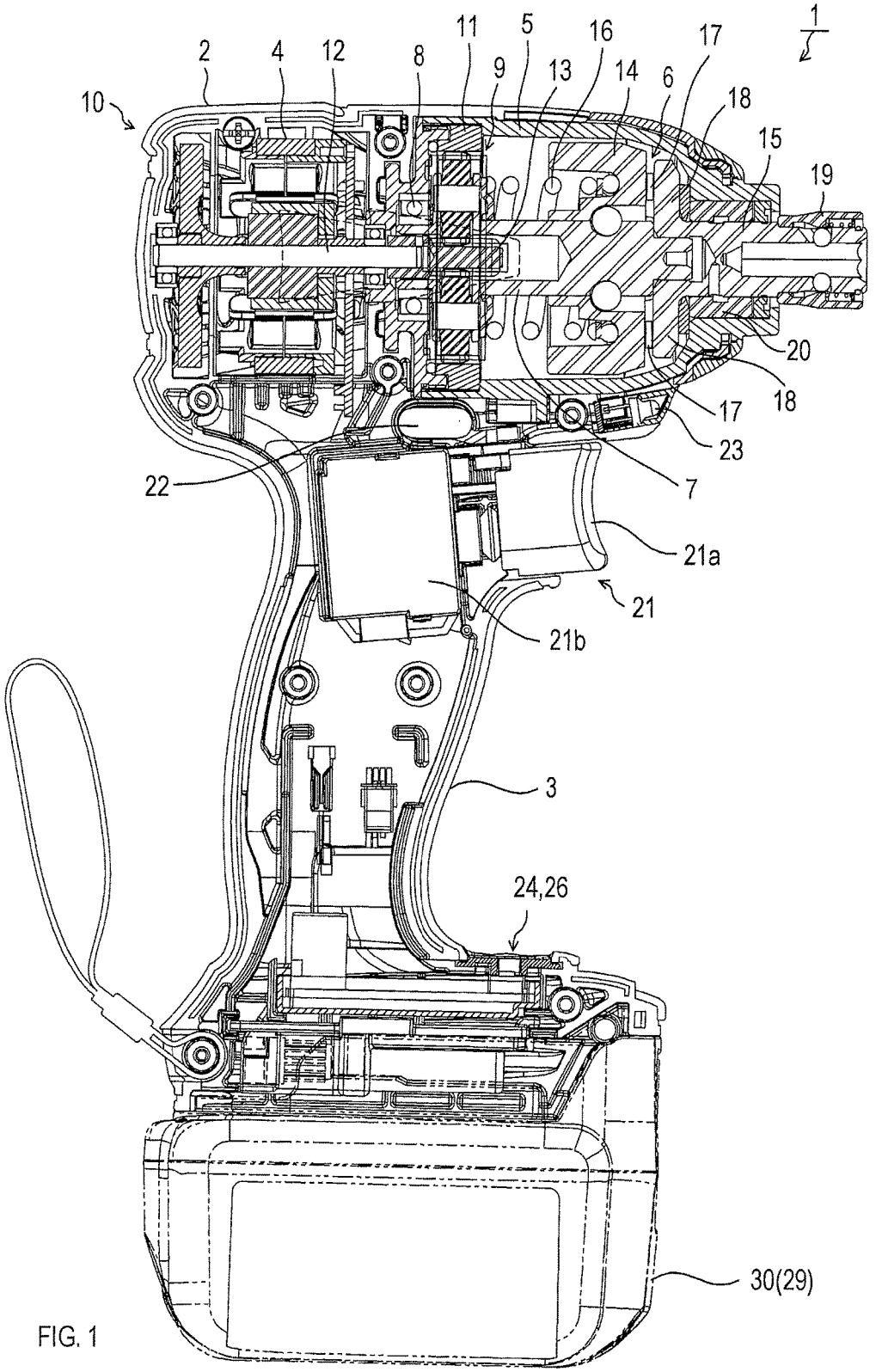
FIG. 1 is a vertical cross-sectional view of a rechargeable impact driver of an embodiment.

As shown in FIG. 1, the driver 1 comprises a tool body 10, and a battery pack 30 that supplies electric power to the tool body 10.

The tool body 10 comprises a housing 2 and a grip portion 3. The housing 2 accommodates a motor 4 and a hitting mechanism 6 to be described later. The grip portion 3 is formed so as to protrude from a lower portion of the housing 2 (lower side of FIG. 1).

Inside the housing 2, the motor 4 is accommodated in its rear portion (left side of FIG. 1), and a bell-shaped hammer case 5 is assembled to the front of the motor 4 (right side of FIG. 1). The hitting mechanism 6 is accommodated in the hammer case 5.

That is, inside the hammer case 5, a spindle 7 with a hollow portion formed at its rear end is coaxially accommodated, and a ball bearing 8 provided at a rear end of the hammer case 5 pivotally supports a rear end outer periphery of the spindle 7.

At a front portion of the ball bearing 8 in the spindle 7, a planetary gear mechanism 9 comprising two planetary gears which are pivotally supported in point symmetry with respect to a rotation axis meshes with an internal gear 11 formed in a rear end inner peripheral surface of the hammer case 5.

The planetary gear mechanism 9 is configured to mesh with a pinion 13 formed at a tip portion of an output shaft 12 of the motor 4.

The hitting mechanism 6 comprises the spindle 7, a hammer 14 fitted over the spindle 7, an anvil 15 pivotally supported in front of the hammer 14, and a coil spring 16 that urges the hammer 14 forward.

That is, the hammer 14 is coupled with the spindle 7 in a manner integrally rotatable and axially movable, and is urged forward (anvil 15 side) by the coil spring 16.

A tip portion of the spindle 7 is pivotally supported by being loosely and coaxially inserted to a rear end of the anvil 15.

The anvil 15 receives a rotational force and a hitting force by the hammer 14 thereby to axially rotate. The anvil 15 is supported in a manner freely rotatable about its axis and axially non-displaceable by a bearing 20 provided at a tip end of the housing 2.

At a tip end of the anvil 15, a chuck sleeve 19 is provided for mounting various tool bits (not shown) such as a driver bit, a socket bit and so on.

All of the output shaft 12 of the motor 4, the spindle 7, the hammer 14, the anvil 15 and the chuck sleeve 19 are coaxially arranged.

In the front end surface of the hammer 14, two hitting protrusions 17, 17 for providing a hitting force to the anvil 15 are circumferentially protruded at an interval of 180°.

The anvil 15 has at its rear end two hitting arms 18, 18 formed at an interval of 180°. The two hitting arms 18, 18 are configured such that each of the hitting protrusions 17, 17 of the hammer 14 can abut on the two hitting arms 18, 18.

When the hammer 14 is urged and held to the front end side of the spindle 7 by an urging force of the coil spring 16, each of the hitting protrusions 17, 17 of the hammer 14 is brought into contact with one of the hitting arms 18, 18 of the anvil 15.

In this state, as the spindle 7 is rotated via the planetary gear mechanism 9 by a rotational force of the motor 4, the hammer 14 is rotated together with the spindle 7, and the rotational force of the hammer 14 is transmitted to the anvil 15 through the hitting protrusions 17, 17 and the hitting arms 18, 18.

Thereby, a driver bit or the like attached to the tip end of the anvil 15 is rotated, and tightening of screw is enabled.

When a predetermined value or more of torque is applied from outside of the anvil 15 to the anvil 15 due to tightening of the screw to a predetermined position, the rotational force (torque) of the hammer 14 to the anvil 15 also becomes equal to or more than a predetermined value.

As a result, the hammer 14 is displaced rearward against the urging force of the coil spring 16. Each of the hitting protrusions 17, 17 of the hammer 14 climbs over one of the hitting arms 18, 18 of the anvil 15. In other words, each of the hitting protrusions 17, 17 of the hammer 14 is once deviated from one of the hitting arms 18, 18 of the anvil 15, and runs idle.

In this way, when the hitting protrusions 17, 17 of the hammer 14 climb over the hitting arms 18, 18 of the anvil 15, the hammer 14 is displaced forward again by the urging force of the coil spring 16 while rotating together with the spindle 7. Then, each of the hitting protrusions 17, 17 of the hammer 14 hits one of the hitting arms 18, 18 of the anvil 15 in the rotation direction.

Accordingly, in the driver 1 of the present embodiment, each time a torque of a predetermined value or more is applied to the anvil 15, hitting by the hammer 14 of the anvil 15 is repeated. As the hitting force of the hammer 14 is applied intermittently to the anvil 15, it is possible to tighten a screw with high torque.

The grip portion 3 is a portion where an operator grips when using the driver 1. A trigger switch 21 is provided above the grip portion 3.

The trigger switch 21 comprises a trigger 21*a* to be pulled by the operator and a switch body 21*b*. The switch body 21*b* is configured such that the switch body 21*b* is turned on and off by the pulling operation of the trigger 21*a* and a resistance value changes in accordance with an operation amount (amount of pull) of the trigger 21*a*.

Also, on top of the trigger switch 21 (lower end side of the housing 2), a forward-reverse changeover switch 22 for switching a rotating direction of the motor 4 between a forward direction (in this embodiment, clockwise direction in a state of viewing front from the rear end side of the tool) and a reverse direction (rotation direction reverse to the forward direction) is provided.

Also, at a bottom front of the housing 2, an illumination LED 23 is provided for illuminating the front of the driver 1 when the trigger 21*a* is pulled.

In addition, at a lower front portion of the grip portion 3, a display panel 24 is provided for displaying an operation mode (high speed, low speed) of the driver 1, remaining energy of a battery 29 and the like.

Figure 2:
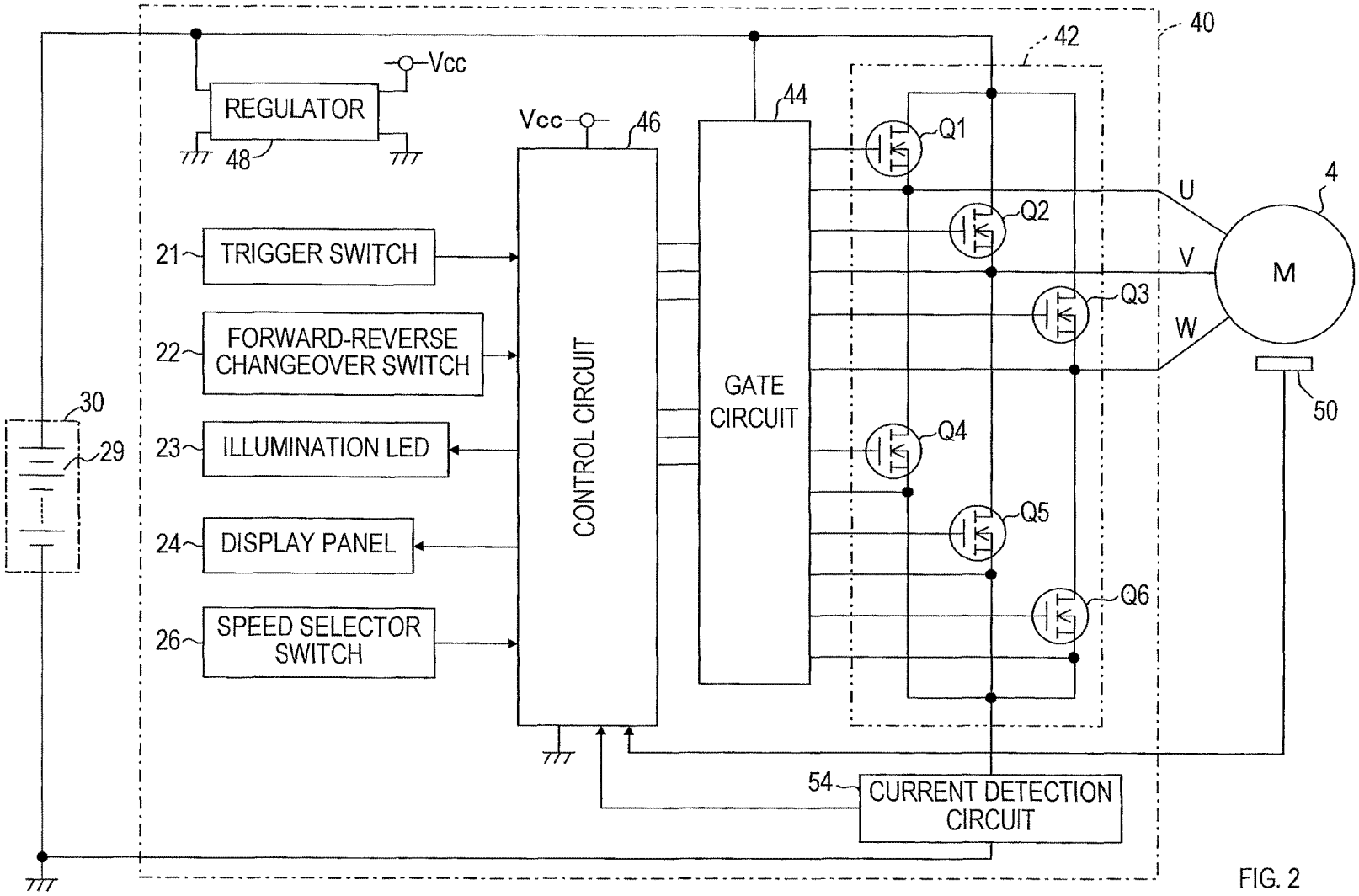
FIG. 2 is a block diagram showing an electrical configuration of a motor driving unit mounted on the rechargeable impact driver.

In the vicinity of the display panel 24, a speed selector switch 26 is provided for setting the operation mode of the driver 1 to either of the low speed mode or the high speed mode (see FIG. 2).

At a lower end of the grip portion 3, a battery pack 30 that accommodates the battery 29 is detachably attached. The battery pack 30 is attached by being slid from the front to rear side with respect to the lower end of the grip portion 3, at the time of the attachment.

The battery 29 accommodated in the battery pack 30 is a repeatedly rechargeable secondary battery such as a lithium ion battery in this embodiment.

The motor 4 is a three-phase brushless motor with an armature winding of each of U, V and W phases, in this embodiment. The motor 4 is provided with a rotation sensor 50 for detecting a rotational position (angle) of the motor 4 (see FIG. 2).

The rotation sensor 50, for example, comprises three Hall elements arranged corresponding to the respective phases of the motor 4, and comprises a Hall IC or the like that is configured to generate a rotation detection signal for each predetermined rotational angle of the motor 4.

Inside the grip portion 3, a motor driving unit 40 is provided that receives power supply from the battery pack 30 and drives and controls the motor 4 (see FIG. 2).

The motor driving unit 40, as shown in FIG. 2, comprises a drive circuit 42, a gate circuit 44, a control circuit 46 and a regulator 48.

The drive circuit 42 receives power supply from the battery 29 to flow a current to each phase winding of the motor 4. In this embodiment, the drive circuit 42 comprises a three-phase full-bridge circuit having six switching elements Q1 to Q6. Each of the switching elements Q1 to Q6 is a MOSFET, in this embodiment.

In the driving circuit 42, the three switching elements Q1 to Q3 are provided between each of U, V, and W terminals of the motor 4 and a power supply line coupled to a positive electrode of the battery 29, as so-called high-side switches.

The other three switching elements Q4 to Q6 are provided between each of the U, V, and W terminals of the motor 4 and a ground line coupled to a negative electrode of the battery 29, as so-called low-side switches.

The gate circuit 44 turns on and off each of the switching elements Q1 to Q6 in the drive circuit 42 in accordance with a control signal output from the control circuit 46, thereby to flow a current to each of the phase windings of the motor 4 to rotate the motor 4.

The control circuit 46 is a microcomputer comprising a CPU, a ROM, a RAM, etc., in this embodiment. The trigger switch 21 (switch body 21*b* in particular), the forward-reverse changeover switch 22, the illumination LED 23, the display panel 24 and the speed selector switch 26 described above are coupled to the control circuit 46.

Further, in the motor driving unit 40, a current detection circuit 54 for detecting a current flowing to the motor 4 is provided in a current path extending from the drive circuit 42 to the negative electrode of the battery 29. The current detection circuit 54, for example, comprises a resistor for current detection and an input circuit for inputting to the control circuit 46 a voltage between both ends of the resistor as a current detection signal.

To the control circuit 46, the current detection signal from the current detection circuit 54, and the rotation detection signal from the rotation sensor 50 provided in the motor 4 are also input.

The control circuit 46, when the trigger switch 21 is operated, obtains the rotational position and rotation speed of the motor 4 based on the rotation detection signal from the rotation sensor 50, and drives the motor 4 in a predetermined direction of rotation in accordance with the rotation direction setting signal from the forward-reverse changeover switch 22.

In addition, the control circuit 46, when the motor 4 is driven, sets a speed command value of the motor 4 in accordance with the operation amount (amount of pull) of the trigger switch 21 and the operation mode (high speed or low speed) set via the speed selector 26.

The control circuit 46 controls the rotation speed of the motor 4 by setting a driving duty ratio of each of the switching elements Q1 to Q6 included in the driving circuit 42 in accordance with the speed command value and outputting to the gate circuit 44 a control signal (PWM signal) in accordance with the driving duty ratio.

The control circuit 46, separately from the drive control for driving the motors 4, also performs control of turning on the illumination LED 23, etc. when the motor is driven.

The regulator 48 receives power supply from the battery 29 to generate a constant power supply voltage Vcc (for example, direct current (DC) 5V) required to operate the control circuit 46. The control circuit 46 operates when the power supply voltage Vcc is supplied from the regulator 48.

Now, a control process to be executed by the control circuit 46 will be described.

Figure 3:
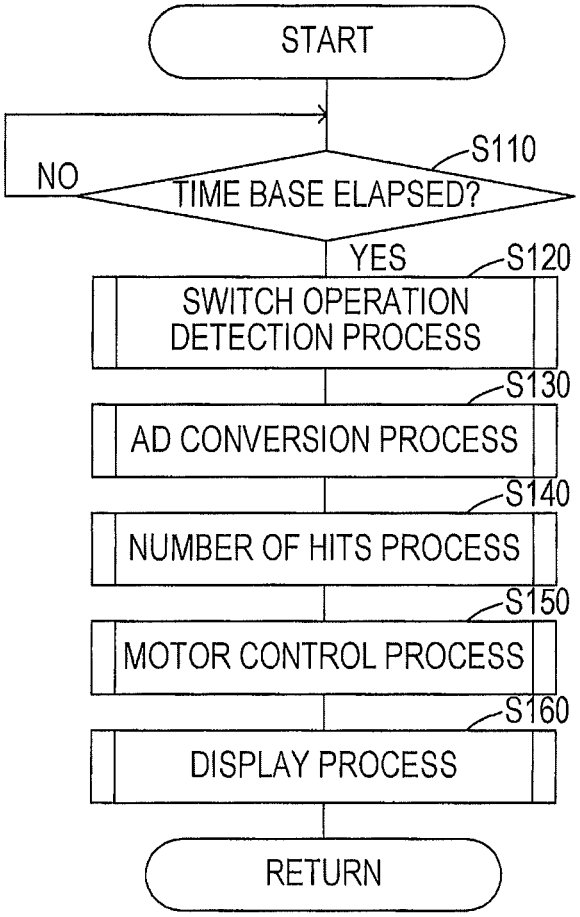
FIG. 3 is a flowchart illustrating a control process executed by a control circuit.

As shown in FIG. 3, the control circuit 46 repeatedly executes a series of processes S120 to S160 (S represents a step) at the predetermined control cycle (time base).

That is, the control circuit 46 waits for a predetermined control period to elapse by determining whether the time base has elapsed in S110. When it is determined in S110 that the time base has elapsed, the process moves to S120.

In S120, by checking signal inputs from the trigger switch 21, the forward-reverse changeover switch 22 and the speed selector switch 26, a switch operation detection process for detecting the operation of the respective switches is performed.

In subsequent S130, an A/D conversion process is performed in which an A/D conversion is applied to the operation amount (amount of pull) of the trigger switch 21, the detection signals from the current detection circuit 54 and the rotation sensor 50, the battery voltage supplied from the battery pack 30, and the like.

In subsequent S140, a number of hits process is executed in which hitting by the hitting mechanism 6 and the number of times of occurrence (number of hits) are detected from changes in the rotation speed of the motor 4 obtained by the detection signal from the rotation sensor 50.

In subsequent S150, a motor control process is executed in which the motor 4 is driven and controlled based on the operation amount of the trigger switch 21, the operation mode set via the speed selector 26, and the result of detection of hitting by the number of hits process.

Finally, in S160, in accordance with a command (operation setting) from a user, a display process is performed which includes a display of the remaining energy of the battery 29 on the display panel 24, lighting of the illumination LED 23, etc. The process moves to S110.

Now, the number of hits process to be executed in S140 will be described.

Figure 4:
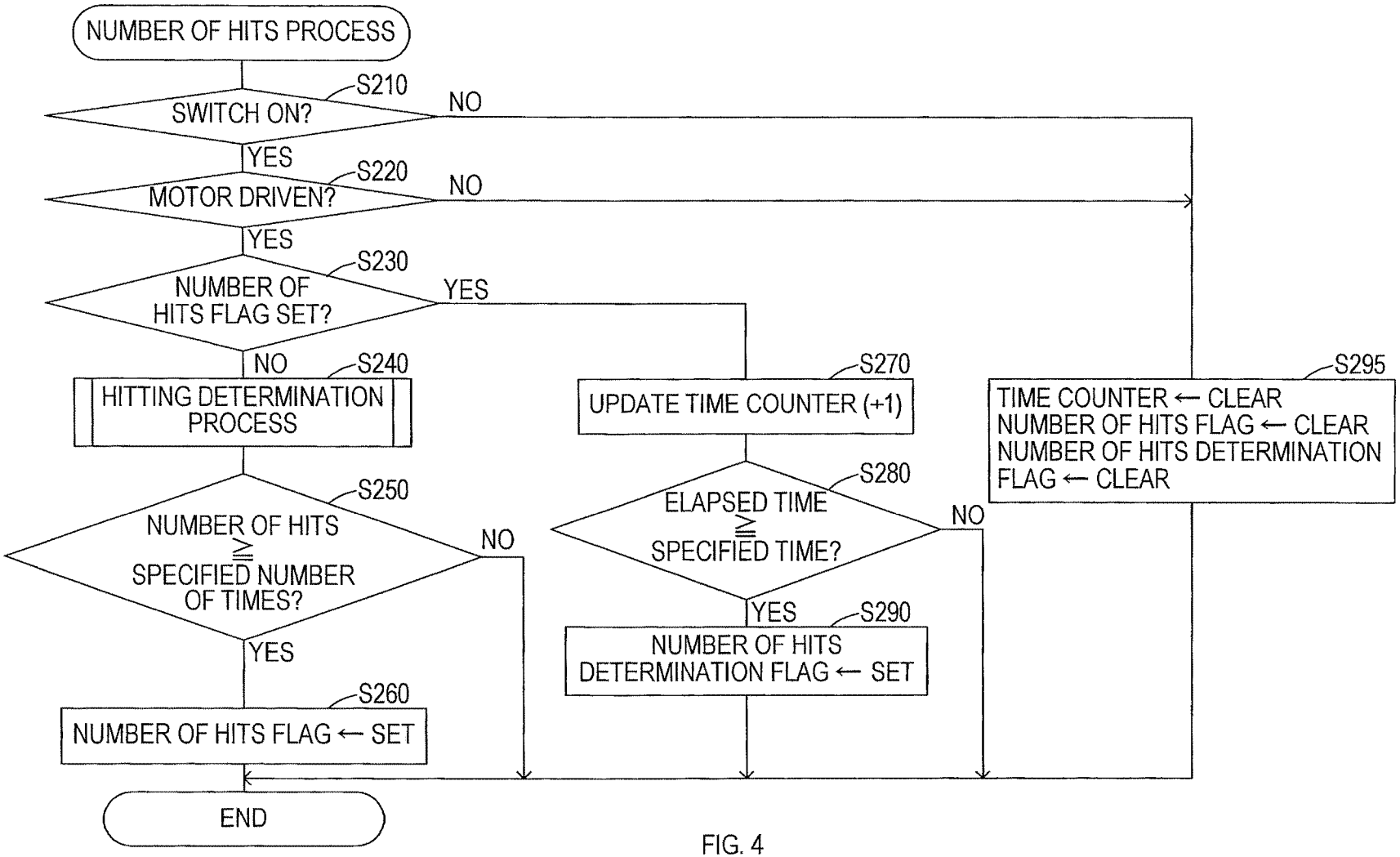
FIG. 4 is a flowchart illustrating a number-of-hits process executed in S140 of FIG. 3.

As shown in FIG. 4, when the number of hits process is started, it is determined first in S210 whether the trigger switch 21 is operated by the user, and is ON. If the trigger switch is ON, the process proceeds to S220. It is determined whether to drive the motor 4 based on the operation amount of the trigger switch 21, etc.

If it is determined not to drive the motor 4 in S220, or if it is determined in S210 that the trigger switch 21 is OFF, the process proceeds to S295. In S295, a time counter, a number of hits flag, and a number of hits determination flag to be described later, are all cleared. The number of hits process is terminated.

On the other hand, if it is determined to drive the motor 4 in S220, the process proceeds to S230. It is determined whether the number of hits flag is set. In S230, if it is determined that the number of hits flag is not set (that is, if it is cleared), the process proceeds to S240. A hitting determination process is executed.

In the hitting determination process, hitting by the hitting mechanism 6 is detected from changes in the rotation speed of the motor 4, and the number of times of detection (that is, number of hits) is counted.

Note that detection of hitting in the hitting determination process can be implemented by detecting changes in the current detected by the current detection circuit 54. Detection of hitting is also implemented by detecting vibration generated by hitting with an acceleration sensor or the like.

When the hitting determination process of S240 is complete, the process proceeds to S250. It is determined whether the number of hits counted in the hitting determination process is equal to or more than a specified number of times. If the number of hits is equal to or more than the specified number of times, the number of hits flag is set in S260, and the number of hits process is terminated. Unless the number of hits is equal to or more than the specified number of times, the number of hits process is terminated.

Next, in S230, when it is determined that the number of hits flag is set, the process proceeds to S270. A time counter for counting drive time of the motor 4 from when the number of hits flag is set in S260 is incremented (+1). The process moves to S280.

In S280, based on the count value of the time counter, it is determined whether time elapsed from when the number of hits reaches the specified number of times is equal to or more than a specified time set in advance. If the elapsed time is equal to or more than the specified time, the process proceeds to S290 to set the number of hits determination flag.

If it is determined in S290 to set number of hits determination flag, or it is determined in S280 that the elapsed time has not reached the specified time, the number of hits process is terminated.

Next, the motor control process executed in S150 of FIG. 3 will be described.

Figure 5:
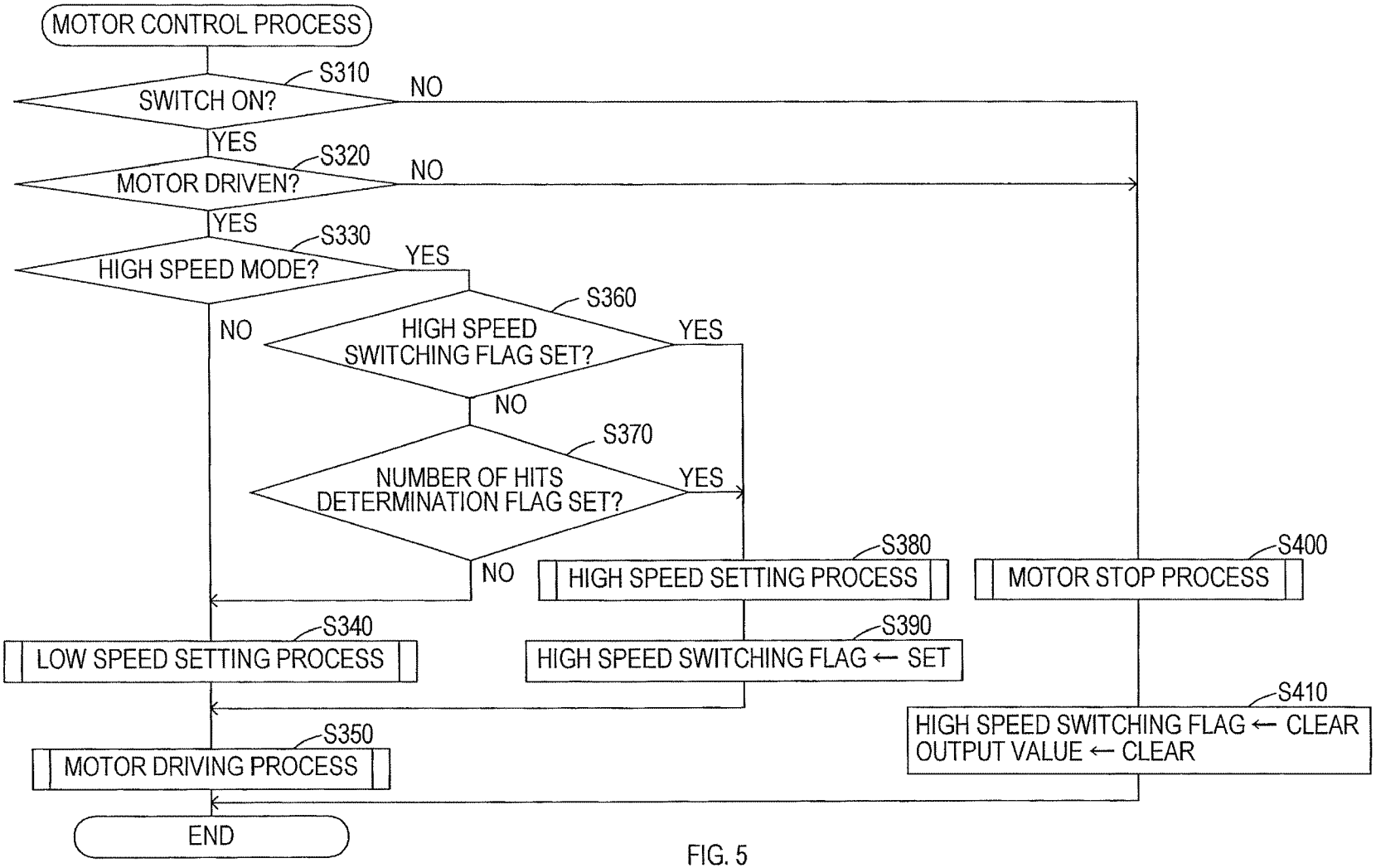
FIG. 5 is a flowchart illustrating a motor control process executed in S150 in FIG. 3.

As shown in FIG. 5, when the motor control process is started, it is determined first in S310 whether the trigger switch 21 is operated by the user and is ON. If the trigger switch 21 is ON, the process proceeds to S320. It is determined whether to drive the motor 4 based on the operation amount of the trigger switch 21.

If it is determined not to drive the motor 4 in S320, or if it is determined in S310 that the trigger switch 21 is OFF, the process proceeds to S400. A motor stopping process for stopping the motor 4 is executed.

In the motor stopping process, the motor 4 is stopped either by generating a braking force in the motor 4 via the drive circuit 42, or simply cutting off the power supply to place the motor 4 into a free-run state.

In subsequent S410, a high speed switching flag and a driving duty ratio that is an output value (in other words, control amount of the motor 4) for driving the motor 4 via the drive circuit 42 to be described later are both cleared. The motor control process is terminated.

Next, in S320, if it is determined to drive the motor 4, the process moves to S330. It is determined whether the operation mode set through the speed selector 26 is a high speed mode.

In S330, if it is determined that the operation mode of the driver 1 is not a high speed mode (that is, low speed mode), the process proceeds to S340. A low speed setting process is executed in which a low speed target value for driving the motor 4 in the low speed mode is set. The process proceeds to S350.

Note that the low speed target value is an output value (driving duty ratio) required to control the rotation speed at no-load of the motor 4 to a set rotation speed N1 (see FIG. 7) in accordance with the operation amount of the trigger switch 21.

In S340, using a map or an arithmetic expression for the low speed mode having the operation amount of the trigger switch 21 as a parameter, the low speed target value (low speed target Duty shown in FIG. 7) is set.

Next, in S330, if it is determined that the operation mode of the driver 1 is the high speed mode, the process proceeds to S360. It is determined whether the high speed switching flag is set.

In S360, if it is determined that the high speed switching flag is not set, the process proceeds to S370. It is determined whether the number of hits determination flag is set.

In S370, if it is determined that the number of hits determination flag is not set, the low speed setting process is executed in S340 and the process proceeds to S350.

On the other hand, if it is determined in S360 that the high speed switching flag is set, or, if it is determined in S370 that the number of hits determination flag is set, the process proceeds to S380. A high speed setting process is executed in which a high speed target value for driving the motor 4 in the high speed mode is set.

In subsequent S390, the high speed switching flag is set, and the process proceeds to S350.

Note that the high speed target value set in S380 is an output value (driving duty ratio) required to control the rotation speed at no-load of the motor 4 to a setting rotation speed N2 (see FIG. 7) in accordance with the operation amount of the trigger switch 21.

In S380, using a map or arithmetic expression for the high speed mode having the operation amount of the trigger switch 21 as a parameter, the high speed target value (high speed target Duty shown in FIG. 7) is set.

Next, in S350, based on the low speed target value set in S340 or the high speed target value set in S380, the output value that is the control amount for actually controlling the motor 4 is set. Then, the motor driving process is executed in which a control signal is generated based on the set output value and is output to the gate circuit 44. After the execution of the motor driving process of S350, the motor control process is terminated.

Next, the motor driving process will be described along the flowchart shown in FIG. 6.

Figure 6:
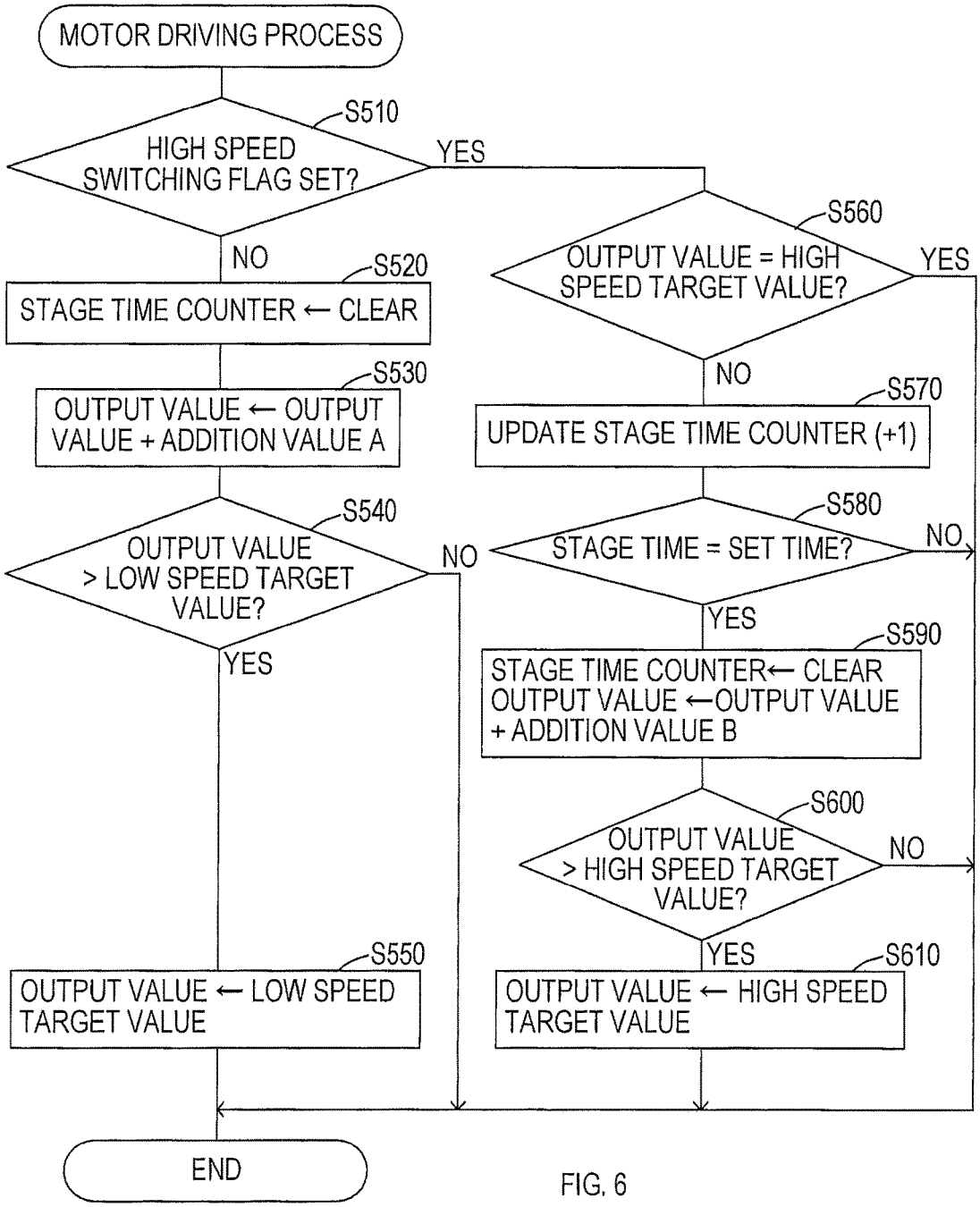
FIG. 6 is a flowchart illustrating a motor driving process executed in S350 in FIG. 5.

As shown in FIG. 6, in the motor control process, it is determined first in S510 whether the high speed switching flag is set.

If the high speed switching flag is not set, a stage time counter to be described later is cleared in S520, and the output value (driving duty ratio) to be used for the drive control of the motor 4 is updated by adding a predetermined addition value A to the current output value in S530. The process proceeds to S540.

In S540, it is determined whether the output value exceeds the low speed target value. If the output value exceeds the low speed target value, the output value is set to be the low speed target value in S550, and the motor driving process is terminated. If the output value does not exceed the low speed target value, the motor driving process is terminated.

Note that the output value is used to generate a control signal (PWM signal) for applying PWM control to the power supplied to the motor 4 via the gate circuit 44 in a control signal output process separately executed in the control circuit 46.

The output value, since it is the driving duty ratio and is "zero" at the time when the motor is stopped, gradually increases from the initial value "zero" by the addition value A to reach the low speed target value (low speed target Duty shown in FIG. 7), due to repetitive execution of the process of S530 after the motor 4 is started driven.

Next, in S510, if it is determined that the high speed switching flag is set, that is, when the operation mode is the high speed mode, the number of hits by the hitting mechanism 6 reaches the specified number, the specified time has elapsed and the high speed target value has been set in S380, the process moves to the S560.

In S560, it is determined whether the output value is equal to the high speed target value. If the output value is equal to the high speed target value, the motor driving process is terminated. If the output value is not equal to the high speed target value, the process proceeds to S570.

In S570, the stage time counter is incremented (+1), and the process moves to S580. In S580, it is determined whether a stage time counted by the stage time counter is equal to a predetermined set time. Unless the stage time is equal to the set time, the motor driving process is terminated. If the stage time is equal to the set time, the process moves to S590.

In S590, the stage time counter is cleared, and the output value (driving duty ratio) is updated by adding a predetermined addition value B to the current output value. Note that the addition value B is set to be less than the addition value A.

In subsequent S600, it is determined whether the output value has exceeded the high speed target value. If the output value has exceeded the high speed target value, the output value is set to be the high speed target value in S610, and the motor drive process is terminated. If the output value has not exceeded the high speed target value, the motor driving process is terminated.

As described above, in the driver 1 of the present embodiment, when the trigger switch 21 is operated and the motor 4 is driven, the output value (driving duty ratio) to the motor 4 is gradually increased to the low speed target value (low speed target Duty) (S530 to S550).

Figure 7:
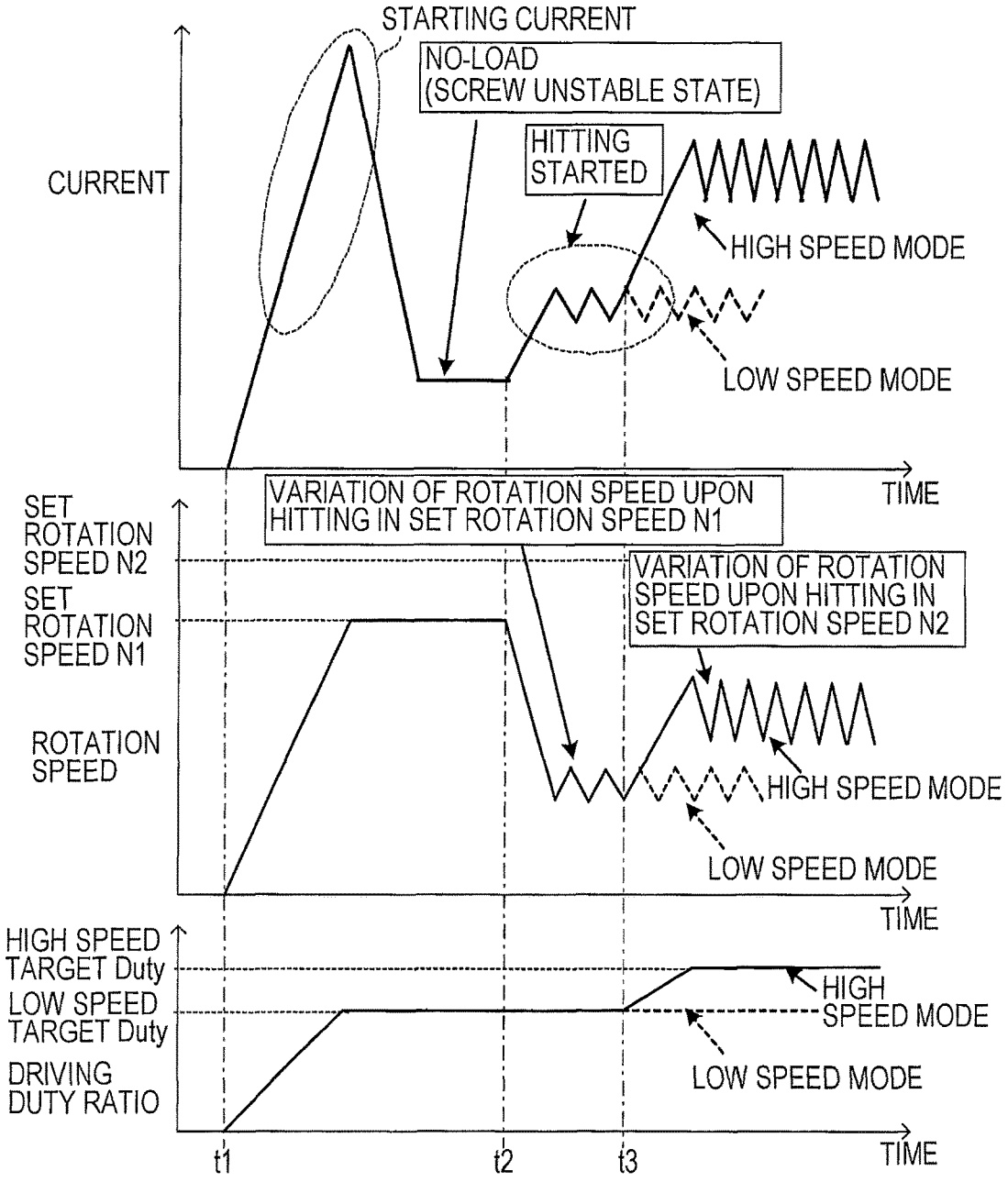
FIG. 7 is a time chart showing a control target set by motor control of the embodiment and changes in rotation speed and current of a motor.

Therefore, as shown in FIG. 7, after the motor 4 is started driven (time t1), the rotation speed of the motor 4 is gradually increased to and held at the set rotational speed N1.

Therefore, when the screw is tightened using the driver 1 of the present embodiment, it is possible to inhibit increase in rotation speed of the motor 4 immediately after the tightening is started, and inhibit the driver bit from being disengaged from the screw, which may result in damaging the screw head and the workpiece.

Further, when a load begins to be applied to the motor 4 by the screw tightening (time t2), the rotation speed of the motor 4 is reduced, and then hitting by the hitting mechanism 6 is started.

If the operation mode is the low speed mode, the output value (driving duty ratio) to the motor 4 is held in the low speed target Duty, and the hitting by the hitting mechanism 6 is continued.

On the other hand, if the operation mode is the high speed mode, when the number of hits by the hitting mechanism 6 reaches the specified number of times, and then, when the specified time elapses (time t3), the control target is switched from the low speed target value (low speed target Duty) to the high speed target value (high speed target Duty).

When the control target is switched, the addition value B is added to the output value (driving duty ratio) whenever the stage time counted by the stage time counter reaches the set time, and the output value (driving duty ratio) increases to the high speed target value (high speed target Duty) in stages (S560 to S610).

That is, when the operation mode is the high speed mode, the driving power of the motor 4 is switched from low power to high power during a initial driving period from when the motor 4 is started driven until the number of hits by the hitting mechanism 6 reaches the specified number of time and the specified time elapses, and after the lapse of the initial driving period.

Therefore, in the high speed mode, the hitting force by the hitting mechanism 6 can be reduced more than normal during the initial driving period of the motor 4. It is possible to inhibit the driver bit from being disengaged from the screw when hitting by the hitting mechanism 6 is started while the screw is not sufficiently inserted to the workpiece.

Further, when the initial driving period elapses in high speed mode, the control target of the motor 4 is switched to the high speed target value that is a final control amount (high speed target Duty) and the hitting force by the hitting mechanism 6 is increased. Thus, it is possible to shorten the time required to tighten the screw to the workpiece.

Further, upon switching the driving duty ratio that is the output value from the low speed target Duty to the high speed target Duty in the high speed mode, the driving duty ratio is increased in stages. Thus, it is also possible to inhibit the rotation speed of the motor 4 from being rapidly increased by the switching of the output value.

In particular, in this embodiment, the addition value B used to increase the driving duty ratio of the low speed target Duty to the high speed target Duty is less than the addition value A used to increases the driving duty ratio from the initial value "0" at the time when driving is stopped to the low speed target Duty.

Therefore, according to this embodiment, it is possible to inhibit increase in rotation speed of the motor 4 as compared to the increase at the time when the motor 4 is started driven, by reducing a rate of increase of the target Duty upon increasing the driving duty ratio from the low speed target Duty to the high speed target Duty as compared to a rate of increase immediately after the motor 4 is started driven (that is, initial rate of change).

Therefore, according to this embodiment, even with this configuration, it is possible to inhibit the driver bit from being disengaged from the screw after the initiation of hitting by the hitting mechanism 6.

In the present embodiment, the speed selector switch 26 corresponds to an example of an operation unit of the present disclosure. The control circuit 46 corresponds to an example of a hitting detector and a control unit of the present disclosure. In particular, the number of hits process executed by the control circuit 46 functions as an example of the hitting detector of the present disclosure, and the motor control process executed by the control circuit 46 functions as an example of the control unit of the present disclosure.

One embodiment of the present disclosure has been described in the above. The present disclosure is not to be limited to the above embodiment and can take various forms within the scope not departing from the gist of the present disclosure.

(First Variation)

For example, in the above embodiment, it is described that, upon switching the output value that is the control amount of the motor 4 in the high speed mode, the driving duty ratio of the motor 4 is switched from the low speed target Duty to the high speed target Duty.

On the other hand, it is also possible to achieve the same effect as in the above embodiment, even if a conduction angle at the time of driving the motor 4 is changed as the control amount of the motor 4, instead of the driving duty ratio of the PWM signal. For this purpose, the motor driving process may be executed according to the procedure shown in FIG. 8.

Note that, in the motor driving process, the target Duty to be set in accordance with the operation amount of the trigger switch 21 is used as the driving duty ratio of the motor 4, so that the target Duty becomes 100% when the operation amount of the trigger switch 21 is the maximum operation amount.

Figure 8:
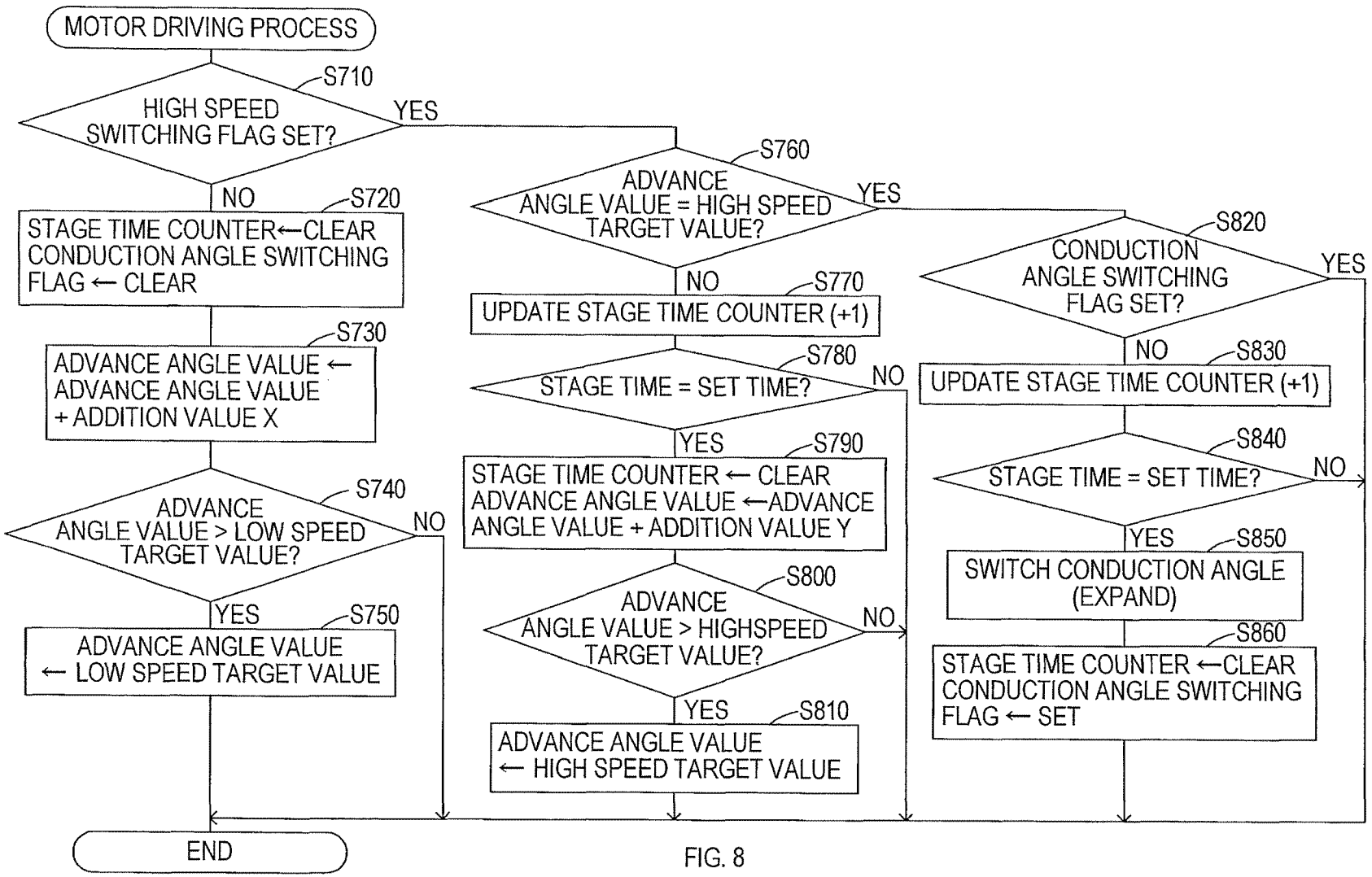
FIG. 8 is a flowchart illustrating a motor driving process of a first variation.

Therefore, in the motor driving process of FIG. 8, a description is given in an assumption that an advance angle value that is a timing to start conduction to each phase winding when the motor 4 is driven and the conduction angle which is the conduction period are set as the output value.

As shown in FIG. 8, in the motor control process, it is determined first in S710 whether the high speed switching flag is set. If the high speed switching flag is not set, the stage time counter and a conduction angle switching flag are cleared in S720.

In subsequent S730, the advance angle value to be used for the drive control of the motor 4 is updated by adding a predetermined addition value X to the current advance angle value. The process proceeds to S740.

In S740, it is determined whether the advance angle value has exceeded the low speed target value (e.g., 22.5°). If the advance angle value has exceeded the low speed target value, the advance angle value is set to be the low speed target value in S750. The motor driving process is then terminated. If the advance angle value has not exceeded the low speed target value, the motor driving process is terminated.

Note that an initial value of the advance angle value is less than the low speed target value (e.g., zero). Therefore, by the process of S730, the advance angle value is gradually increased when the motor 4 is driven, and the conduction start timing of the motor 4 moves toward the advance angle side, thereby to increase the driving power of the motor 4 (and thus driving torque).

Next, in S710, when it is determined that the high speed switching flag is set, the process proceeds to S760. It is determined whether the advance angle value is equal to the high speed target value (e.g., 37.5°). Unless the advance angle value is equal to the high speed target value, the process proceeds to S770. If the advance angle value is equal to the high speed target value, the process moves to S820.

In S770, the stage time counter is incremented (+1). The process moves to S780. In S780, it is determined whether the stage time counted by the stage time counter is equal to a predetermined set time. If the stage time is not equal to the set time, the motor driving process is terminated. If the stage time is equal to the set time, the process moves to S790.

In S790, the stage time counter is cleared. The advance angle value is updated by adding a predetermined addition value Y to the current advance angle value. The process proceeds to S800.

In S800, it is determined whether the advance angle value has exceeded the high speed target value. If the advance angle value has exceeded the high speed target value, the advance angle value is set to be the high speed target value in S810. The motor driving process is terminated. If the advance angle value has not exceeded the high speed target value, the motor driving process is terminated.

Next, in S820, it is determined whether the conduction angle switching flag is set. If the conduction angle switching flag is set, the motor driving process is terminated. Unless the conduction angle switching flag is set (that is, if it is cleared), the process proceeds to S830.

In S830, the stage time counter is incremented (+1). In subsequent S840, it is determined whether the stage time counted by the stage time counter is equal to the predetermined set time. Note that the set time may be the same as the set time for use in the determination of S780, or may be different.

In S840, if it is determined that the stage time is not equal to the set time, the motor driving process is terminated. If it is determined that the stage time is equal to the set time, the process proceeds to S850. The conduction angle at the time of driving the motor 4 is increased.

That is, in S850, a conduction end timing to the phase windings is delayed by a predetermined angle (e.g., 15°) so that the conduction angle at the time of driving the motor becomes equal to the high speed target value (e.g., 150°) that is greater than the low speed target value (e.g., 120°).

In subsequent S860, the stage time counter is cleared, and the conduction angle switching flag is set. The motor driving process is terminated.

Figure 9:
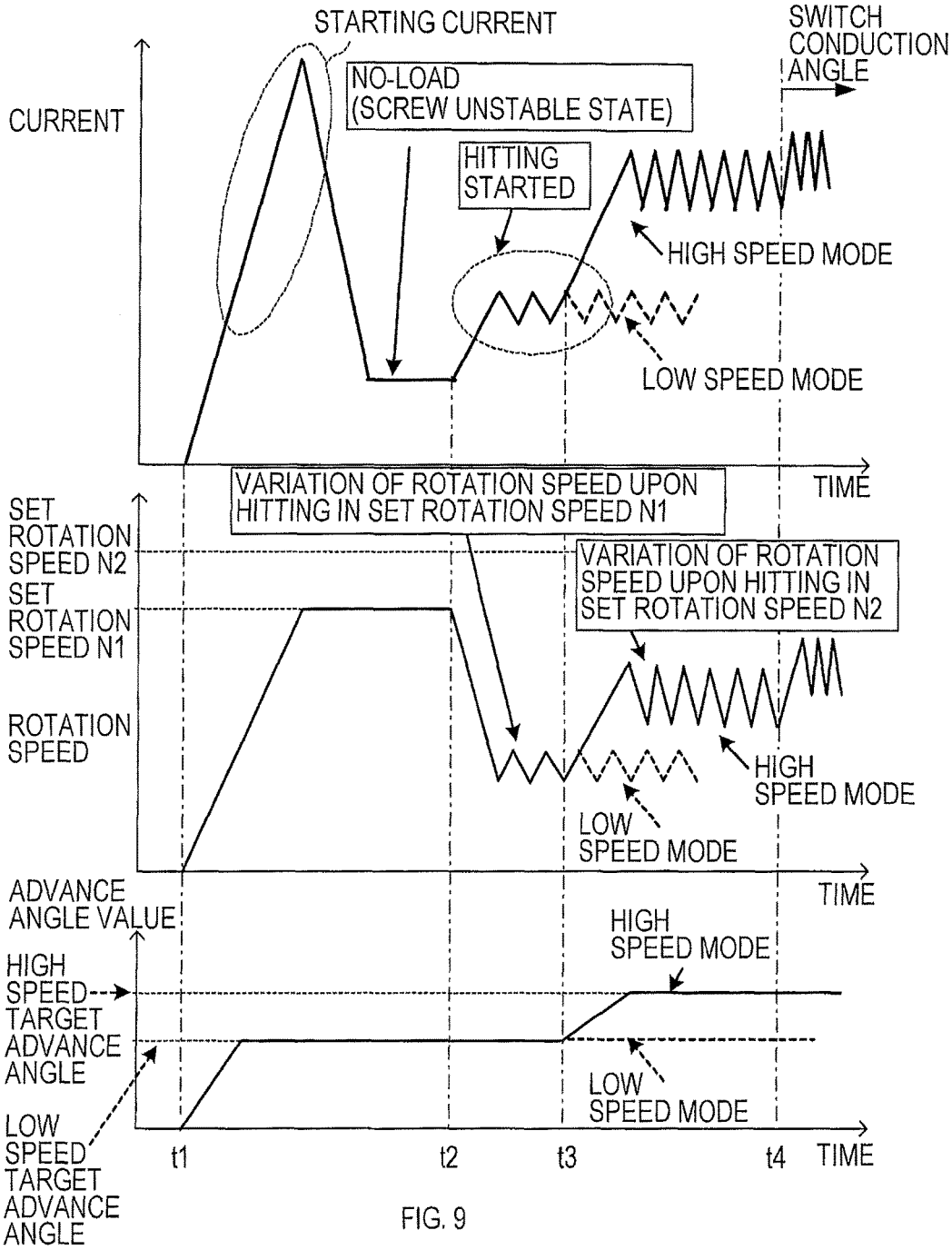
FIG. 9 is a time chart showing a control target and changes in rotation speed and current of a motor in the first variation.

Thus, in the motor driving process shown in FIG. 8, the advance angle value at the time of driving the motor 4 is gradually increased up to the low speed target value (low speed target advance angle value) after the motor 4 is started driven (time t1) as shown in FIG. 9. Thereby, the rotation speed of the motor 4 is increased to the set rotation speed N1 (S720 to S750).

When a load is started to be applied to the motor 4 by screw tightening (time t2), the rotation speed of the motor 4 is reduced. Then, although the hitting by the hitting mechanism 6 is started, the advance angle value is held to the low speed target advance angle value if the operation mode is the low speed mode, and the conduction angle to the motor 4 is also fixed to a predetermined low speed target value.

On the other hand, if the operation mode is the high speed mode, and when the number of hits by hitting mechanism 6 reaches the specified number of times and when the specified time elapses (at time t3), the control target of the advance angle value is switched from the low speed target advance angle value to a high speed target advance angle value.

When the control target of the advance angle value is switched, the addition value Y is added to the advance angle value each time the stage time counted by the stage time counter reaches the set time, and the advance angle value increases up to the high speed target advance angle value in stages (S770 to S810).

That is, in case that the operation mode is the high speed mode, when the number of hits by the hitting mechanism 6 reaches the specified number of times and the specified time elapses from when the motor 4 is started driven, the advance angle value at the time of driving the motor 4 is corrected toward the advance angle side than the advance angle value in the low speed mode, and the conduction angle to the motor 4 is gradually increased.

Therefore, in the high speed mode, the hitting force by the hitting mechanism 6 is reduced to the same extent as in the low speed mode during the initial driving period of the motor 4. Even in the first variation, the same effect as in the above embodiment can be achieved.

In the high speed mode, as shown in FIG. 9, when the advance angle value reaches the high speed target advance angle value (at time t4), the conduction end timing to each of the phase windings is delayed by a predetermined angle after a predetermined set time elapses, so that the conduction angle becomes equal to the high speed target value (e.g. 150°) (S830 to S860).

As a result, according to the first variation, the rotation speed of the motor 4 is further increased by switching the conduction angle in the high speed mode. It is possible to shorten the time required to tighten the screw to the workpiece.

In the first variation, if the operation amount of the trigger switch 21 is the maximum operation amount, the driving duty ratio of the motor 4 can be 100%. Thus, as compared with a case in which the driving duty ratio of the motor 4 is controlled, it is possible to reduce heat generation of the switching element inside the drive circuit 42.

(Second Variation)

In the above embodiment and variation, when switching the control amount (driving duty ratio or advance angle value) to the final control amount (high speed target Duty or high speed target advance angle value) in the high speed mode, the control amount is gradually changed at a constant rate of change to be determined by the addition value B or Y.

Figure 10:
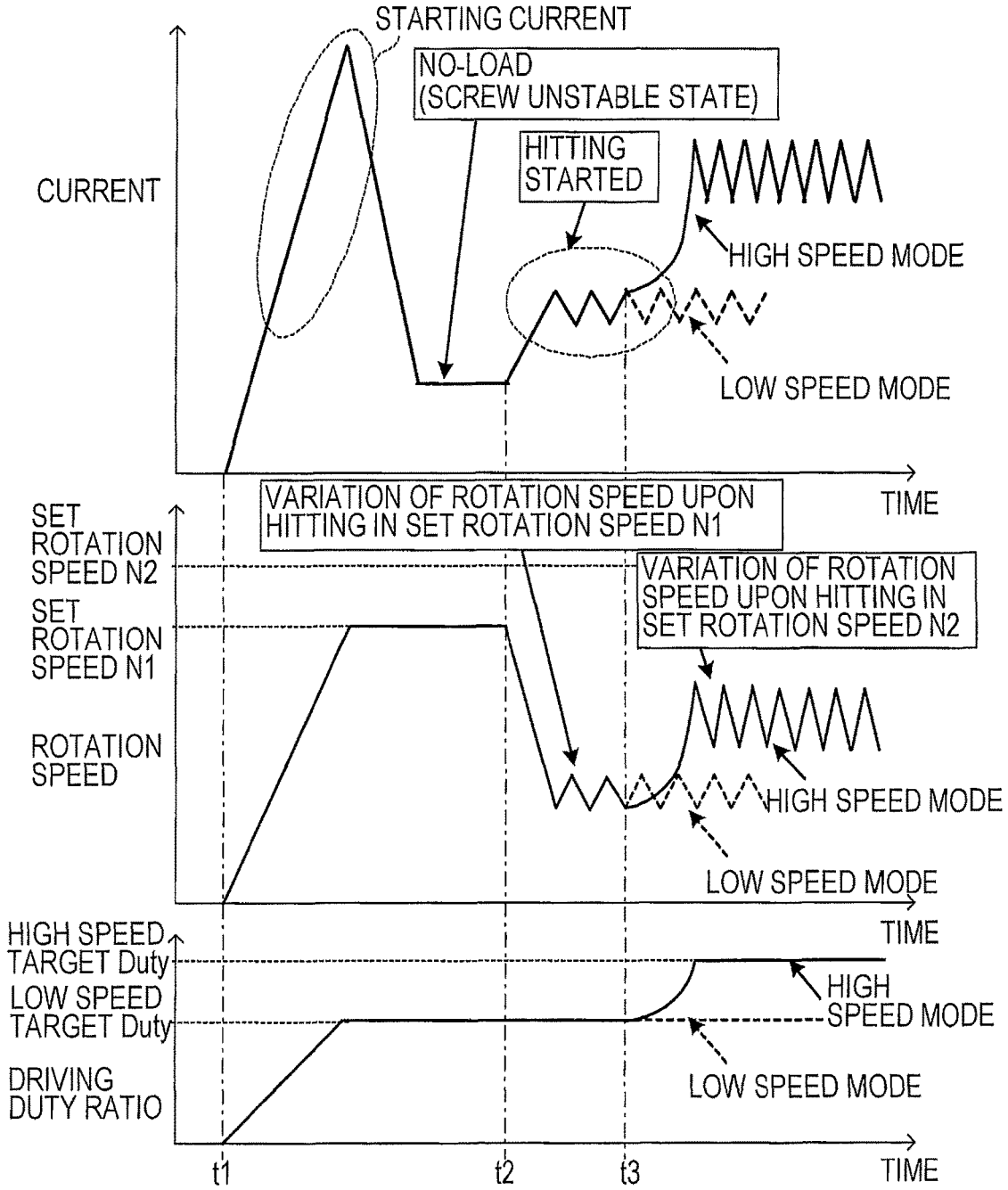
FIG. 10 is a time chart showing a control target and changes in rotation speed and current of a motor in a second variation.

However, upon switching the control amount to the final control amount as such, the rate of change (rate of increase) of the control amount may be changed so as to gradually increase in accordance with the elapsed time, as illustrated in FIG. 10.

That is, in FIG. 10, in the driver 1 of the embodiment, when the operation mode is the high speed mode, the initial driving period elapses, and the control target of the motor 4 is switched to the high speed target Duty, the driving duty ratio is changed (increased) in an arched shape.

Specifically, the rate of increase of the driving duty ratio after the lapse of the initial driving period (time t3 or later) is less than the rate of increase immediately after the motor 4 is started driven immediately after the lapse of the initial driving period, and then gradually increases to eventually become more than the rate of increase immediately after the motor 4 is started driven.

Thus, if the driving duty ratio after the lapse of the initial driving period is increased in an arched shape up to the high speed target Duty, it is possible to inhibit the increase in rotation speed of the motor 4 immediately after the lapse of the initial driving period.

In particular, in the time chart shown in FIG. 10, the rate of increase of the driving duty ratio immediately after the lapse of the initial driving period is less than the rate of increase immediately after the motor 4 is started driven. It is possible to satisfactorily inhibit rapid increase in the rotation speed of the motor 4.

Therefore, according to the second variation, it is possible to more reliably inhibit the driver bit from being disengaged from the screw after the hitting is started.

Furthermore, since the rotation speed of the motor is increased in an arched shape with the time elapsed from the initial driving period, it is possible to inhibit the time required for the tightening of the screw from being prolonged.

Figure 11:
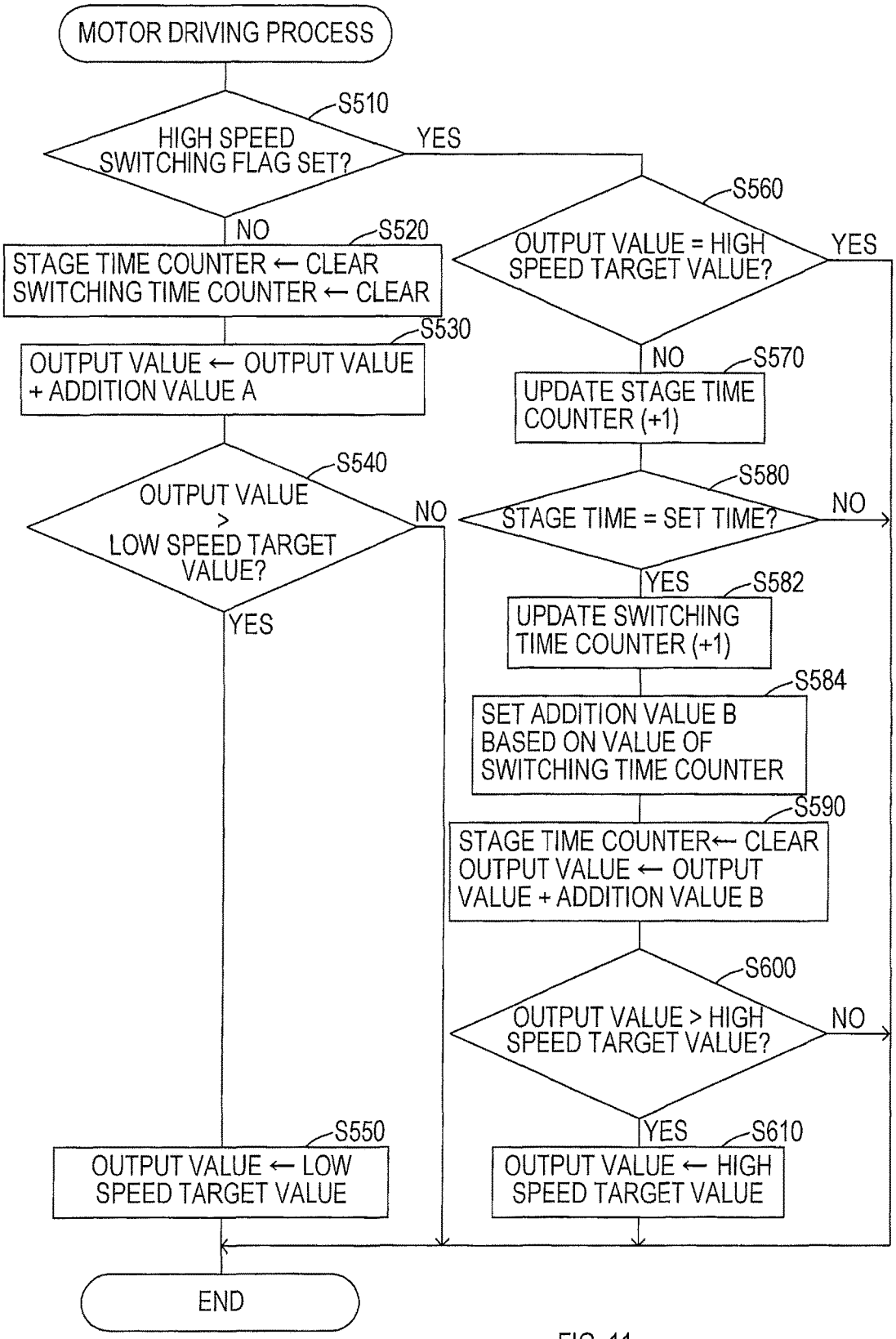
FIG. 11 is a flowchart illustrating a motor driving process of the second variation.

In order to change the driving duty ratio in an arched shape after the lapse of the initial driving period as such, the motor driving process shown in FIG. 6 may be changed as shown in FIG. 11. This change will be explained below.

In the motor driving process shown in FIG. 11, the processes of S582 and S584 are executed from when it is determined in S510 that the high speed switch flag is set until when it is determined in S560 that the output value is equal to the high speed target value or it is determined in S580 that the stage time is equal to the set time.

In S582, by updating (+1) a switching time counter which is cleared with the stage time counter in S520, time elapsed from when the high speed switching flag is set until when the output value reaches the high speed target value is counted.

In subsequent S584, on the basis of the count value of the switching time counter (that is, elapsed time after the end of the initial driving period), the addition value B is set. The process of S584 is a process for changing the output value in an arched shape by increasing the addition value B in accordance with the elapsed time after the end of the initial driving period. To set the addition value B, an arithmetic expression having the count value of the switching time counter as a parameter, or the map is used.

In S584, when the addition value B is set, the process proceeds to S590. By adding the set addition value B to the output value, the output value is updated. The process of S600 and the subsequent steps are executed.

Thus, after the lapse of the initial driving period, the driving duty ratio of the motor 4 that is the output value is increased in an arched shape as shown in FIG. 10. The above effect can be exhibited.

(Third Variation)

In the above embodiment and variations, the initial driving period after the motor 4 is started driven until the control target of the driving duty ratio is switched from the low speed target Duty to the high speed target Duty is a period until when the number of hits by the hitting mechanism 6 reaches the specified number of times and then the predetermined set time elapses.

However, the initial driving period may be defined simply by the number of times of hits by the hitting mechanism 6, or may be defined only by the elapsed time after the motor 4 is started driven.

(Fourth Variation)

In the above embodiment and variations, it is described that the control amount (driving duty ratio or advance angle value) is not switched in the low speed mode.

This is because, in the low speed mode, the driving duty ratio or the advance angle value to be the final target is low, and it is considered that, even if the motor 4 is driven and controlled with the control amount, the driver bit will never be disengaged from the screw when hitting occurs.

However, even in the low speed mode, sometimes the driver bit is disengaged from the screw when hitting occurs. In such cases, the driving duty ratio may be switched, similar to the case in the high speed mode.

In the above embodiment and the variations, the rechargeable impact driver 1 is described in which the operation mode can be switched to two stages of low speed and high speed via the speed selector switch 26. However, the present disclosure can be further applied, for example, to a rechargeable impact driver in which the operation mode can be switched to three stages of low speed, medium speed and high speed, or even more stages, similar to the case in the above embodiment.

Figure 12A:
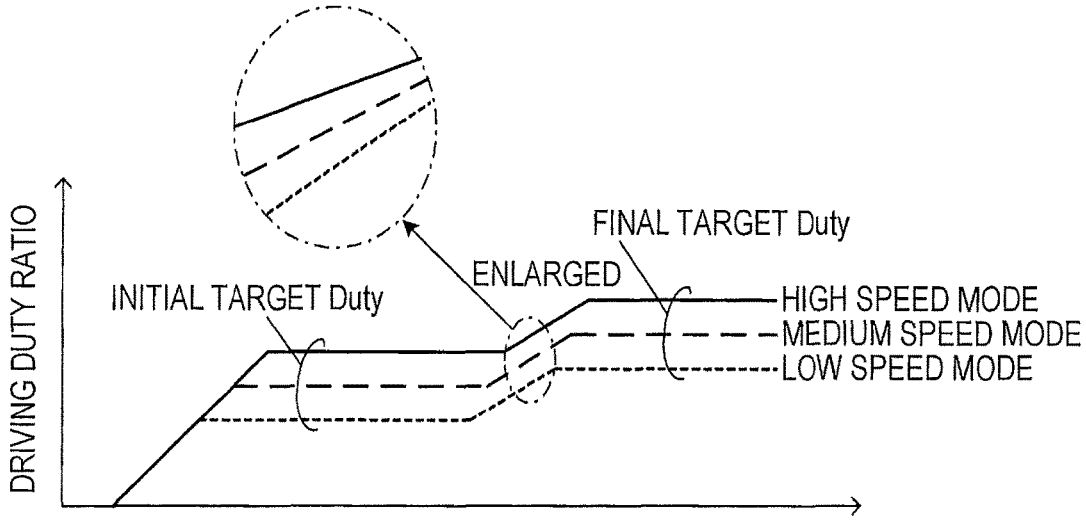
FIGS. 12A and 12B are time charts for explaining an example of a setting procedure of a control target by motor control of a fourth variation.
Figure 13:
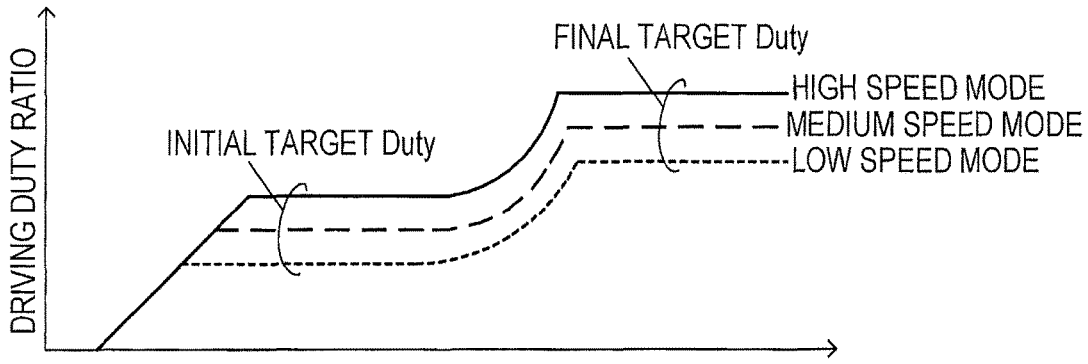
FIG. 13 is a time chart for explaining another example of the setting procedure of the control target by the motor control of the fourth variation.

Upon enabling the operation mode to be switched to three stages, the driving duty ratio may be switched even in the low speed mode and the medium speed mode, similar to the case in the high speed mode, as illustrated in FIG. 12A or 13.

Note that, upon switching the driving duty ratio to such a plurality of operation modes, a motor control process for each operation mode (see FIG. 5) may be performed per operation mode, and the control amount (driving duty ratio or conduction angle) between the initial driving period and a final driving period after the lapse of the initial driving period may be switched.

Also in this case, as is apparent from the enlarged view shown in FIG. 12A, upon changing the control amount up to the final control amount after the lapse of the initial driving period, the rate of change of the control amount for each operation mode may be set, for example, by setting the addition value B or Y different in each operation mode.

Figure 12B:
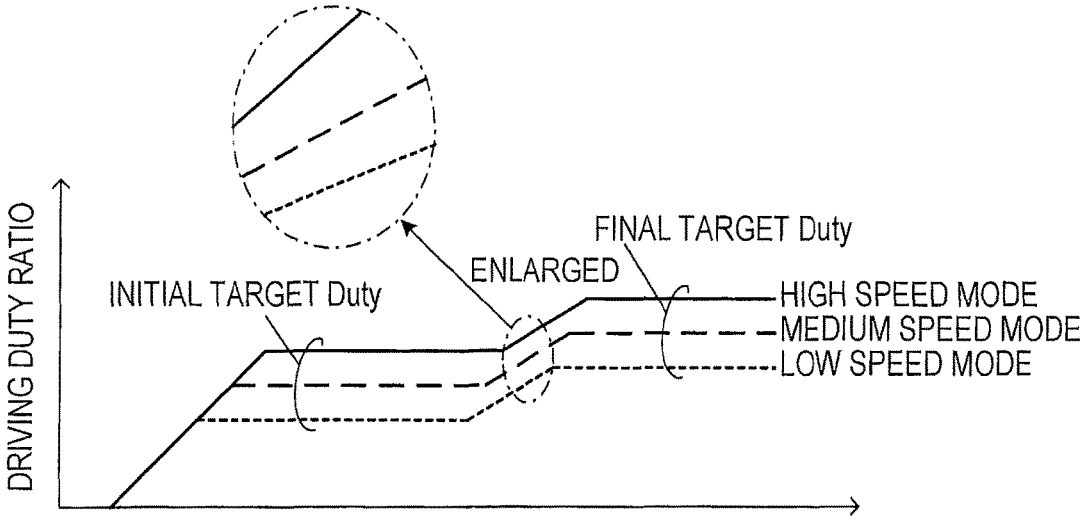

Note that in the enlarged view of FIG. 12A, the rate of change (slope to a direction of increase) of the driving duty ratio upon changing the driving duty ratio up to the final target Duty is greater in the low speed mode than in the high speed mode. However, as shown in the enlarged view of FIG. 12B, the rate of change in high speed mode may be greater than the rate of change in the low speed mode. In other words, a difference in the rate of change may be set as appropriate depending on the characteristics of the motor to be controlled (i.e., tool).

As described in the second variation, FIG. 13 shows that the control amount is varied in an arched shape by increasing the rate of change of the control amount over time. In this case, a map used to set the addition values B and Y in accordance with the elapsed time may be prepared for each operation mode.

(Fifth Variation)

In the above embodiment and variations, it is described that, if the operation mode is the high speed mode, the control amount (driving duty ratio or conduction angle) of the motor 4 is always switched.

However, this switching is not necessary to be performed at all times. For example, the user may be able to select whether to perform similar switching control to that of the above embodiment, or to perform control with the final control amount in the high speed mode without performing the switching control.

In this way, it is possible to further improve usability of the rechargeable impact driver 1.

(Sixth Variation)

In the above embodiment and the variations, it is described that the control circuit 46 sets the control amount (driving duty ratio or conduction angle) of the motor 4 based on the speed command value set in accordance with the operation mode (high speed or low speed).

However, the control circuit 46 may be configured such that the target rotation speed of the motor 4 is set in accordance with the operation mode (high speed or low speed), and, at the time of driving of the motor 4, the motor 4 is driven and controlled so that the rotation speed of the motor 4 becomes equal to the target rotation speed.

Figure 14:
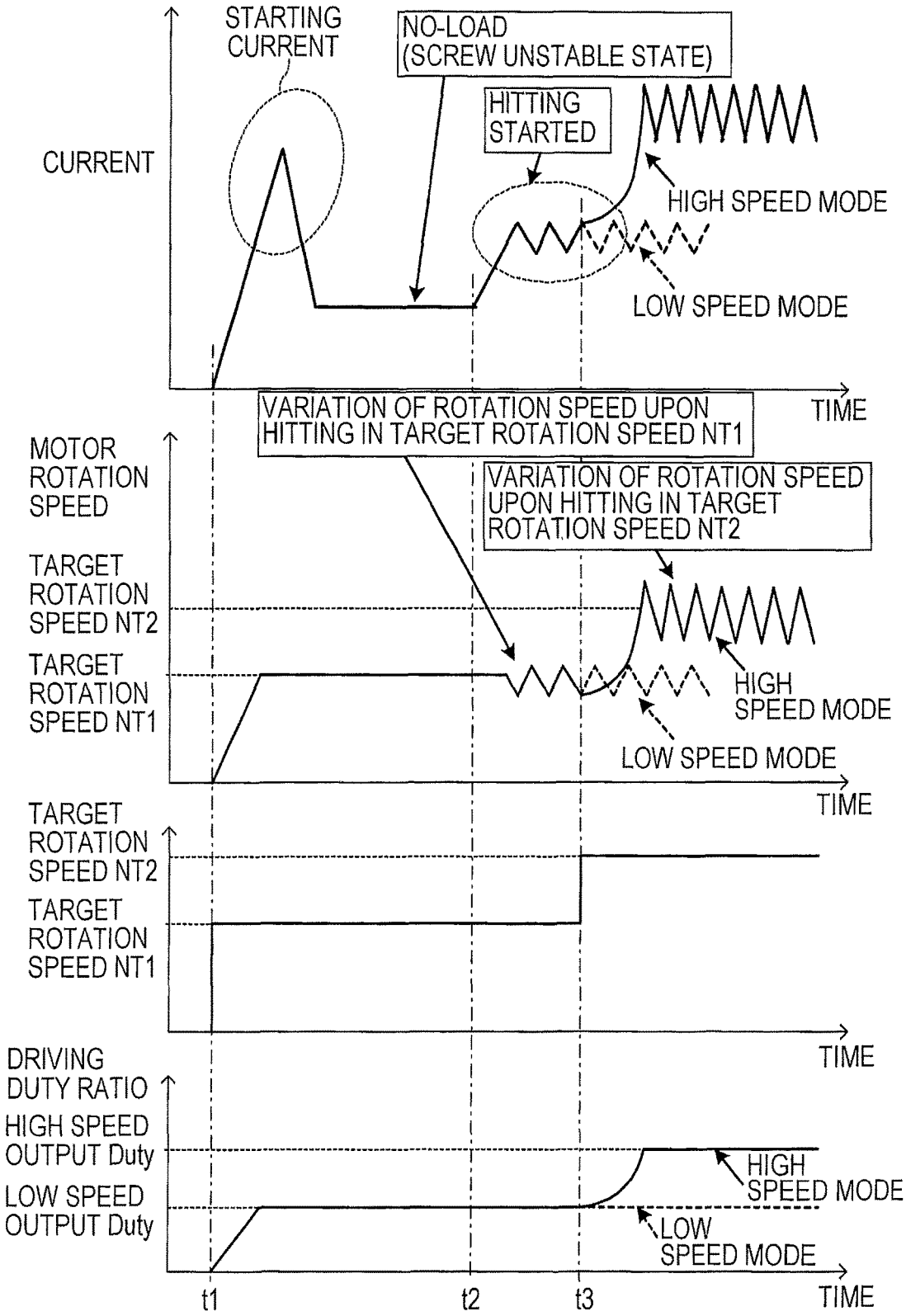
FIG. 14 is a time chart showing a control target and changes in rotation speed and current of a motor in a sixth variation.

For example, as shown in FIG. 14, the target rotation speeds NT1, NT2 are set in accordance with the operation mode (low speed mode, high speed mode), and feedback control is applied to the motor 4 so that the rotation speed of the motor 4 becomes equal to the set target rotation speed NT1, NT2.

In this sixth variation as well, similar to the embodiment described above, the motor 4 may be driven and controlled, in the high speed mode, at the target rotation speed NT1 in the low speed mode during the initial driving period of time t1 to t3, and the target rotation speed may be switched to the target rotation speed NT2 after the lapse of the initial driving period.

Note that FIG. 14 shows that, after the target rotation speed is switched with the lapse of the initial driving period, then the driving duty ratio that is the control amount is gradually (specifically, in an arched shape, as in the second variation) changed until the rotation speed of the motor 4 reaches the target rotation speed NT2.

In the case of controlling the rotation speed of the motor 4 as such, the target rotation speed NT1 may be set as a target rotation state of the motor 4 in S340 of the motor control process shown in FIG. 5, and the target rotation speed NT2 may be set as the target rotation state of the motor 4 in S380.

Figure 15:
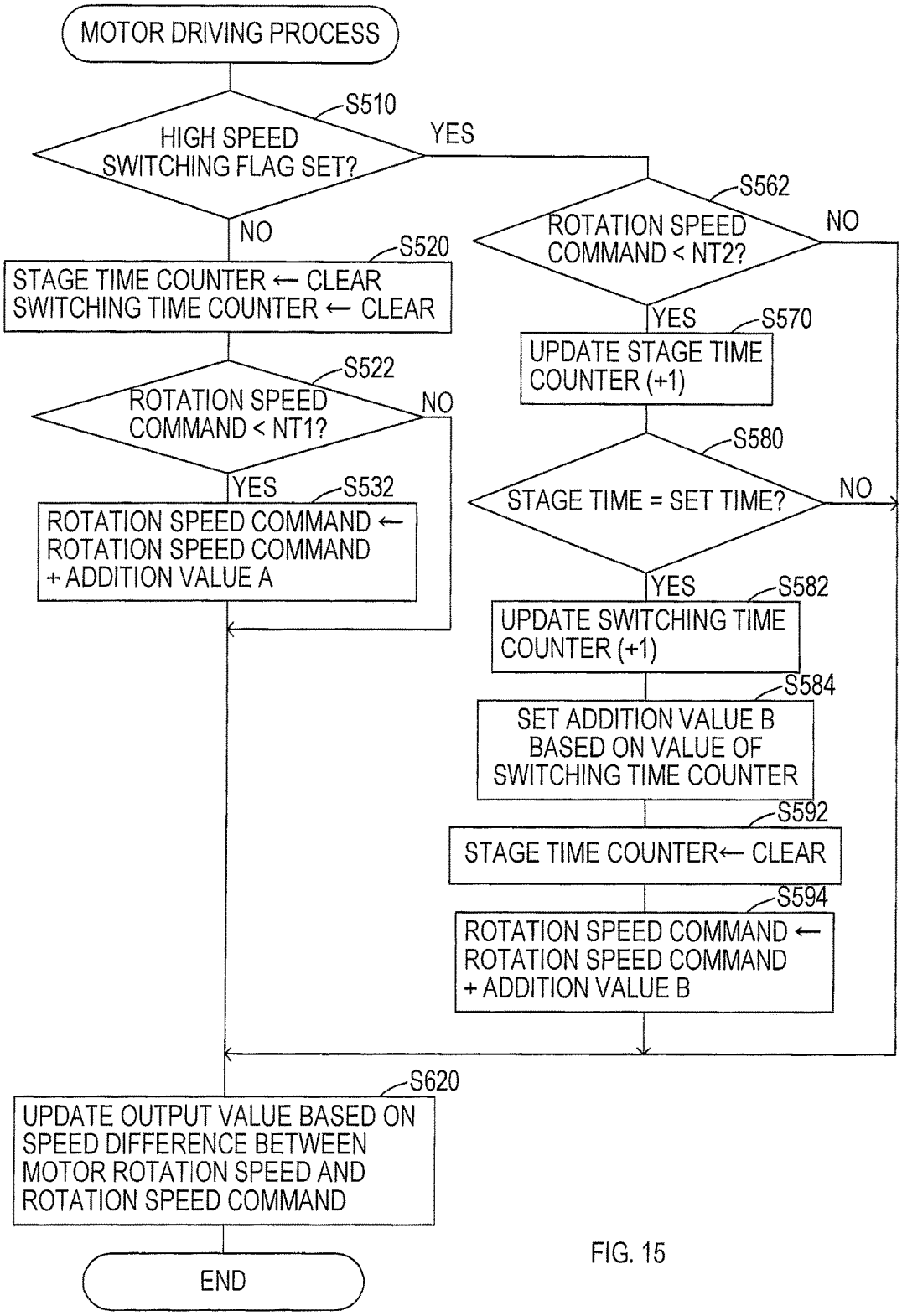
FIG. 15 is a flowchart illustrating a motor driving process of the sixth variation.

In this case, the motor driving process of S350 may be implemented by the procedure shown in FIG. 15. Hereinafter, the motor driving the process of FIG. 15 will be explained.

In the motor driving process of FIG. 15, similar to the motor driving process shown in FIG. 11, when it is determined in S510 that the high speed switching flag is not set, the stage time counter and the switching time counter are cleared in S520.

In subsequent S522, it is determined whether a rotation speed command to the motor 4 is less than the target rotation speed NT1. If the rotation speed command is less than the target rotation speed NT1, the process proceeds to S532. The rotation speed command is updated by adding the addition value A to the rotation speed command.

If the rotation speed command is updated in S532, or it is determined that the rotation speed command has reached the target rotation speed NT1 in S522, the process proceeds to S620.

On the other hand, if the high speed switching flag is set, it is determined in S562 whether the rotation speed command is less than the target rotation speed NT2.

If the rotation speed command is less than the target rotation speed NT2, the stage time counter is incremented (+1) in S570. It is determined in S580 whether the stage time counted by the stage time counter is equal to the set time.

If it is determined in S562 that the rotation speed command has reached the target rotation speed NT2, or if it is determined in S580 that the stage time is not equal to the set time, the process proceeds to S620.

If it is determined in S580 that the stage time is equal to the set time, the switching time counter is updated (+1) in S582, and the addition value B is set in S584 based on the count value of the switching time counter, similar to the case of the motor driving process shown in FIG. 11.

In S592, the stage time counter is cleared. In subsequent S594, the rotation speed command is updated by adding the addition value B to the rotation speed command. The process proceeds to S620.

In S620, on the basis of the speed difference between the rotation speed of the motor 4 and the rotation speed command, the output value (driving duty ratio) is updated (increased or reduced). The motor driving process is terminated.

As a result, the rotation speed of the motor 4 is controlled to the target rotation speed NT1 or NT2.

The embodiment and variations of the present disclosure have been described in the above. However, the present disclosure is not to be limited to a rechargeable impact driver, and can be applied to all kinds of electric power tools provided with a hitting mechanism driven by a motor, such as, for example, an impact wrench.

In the above embodiment and variations, the motor 4 is described as a three-phase brushless motor, but may be any motor that can rotationally drive the hitting mechanism 6. That is, for example, the present disclosure is not limited to battery powered tools, and may be applied to electric power tools that receive power supply via a code, or may be electric power tools configured to rotationally drive a tool element by an alternate current (AC) motor.

In the above embodiment and variations, the control circuit 46 is a microcomputer, but may be a combination of various individual electronic parts, may be an ASIC (Application Specified Integrated Circuit), may be a programmable logic device such as, for example, a FPGA (Field Programmable Gate Array), or may be a combination thereof.

What is claimed is:

1. An electric power tool comprising:

a motor configured to generate a rotational force;

an anvil configured to be rotated by the rotational force and having a tool element attached thereto;

a hitting mechanism configured to generate a hitting force on the anvil in a rotation direction of the anvil when a torque of a predetermined value or more is applied to the anvil or the tool element;

a hitting detector configured to detect a hit by the hitting mechanism on the anvil; and a control unit configured to control an output value for driving of the motor, the control unit further configured to set a low speed target value to the output value during an initial driving period, and to set a high speed target value to the output value when the initial driving period elapses, the initial driving period being a period, after the motor is started driven, from when the hit by the hitting mechanism on the anvil is detected by the hitting detector until a predetermined first time period elapses.

2. The electric power tool according to claim 1, wherein the control unit is configured to determine that the initial driving period has elapsed when the hit by the hitting mechanism on the anvil is detected a predetermined number of times by the hitting detector, after the motor is started driven, and set the high speed target value to the output value.

3. The electric power tool according to claim 1, wherein the control unit is configured to determine that the initial driving period has elapsed when a predetermined time elapses since the hit by the hitting mechanism on the anvil has been detected by the hitting detector, after the motor is started driven, and to set the high speed value to the output value.

4. The electric power tool according to claim 1, further comprising a speed detector configured to detect a rotation speed of the motor, wherein the control unit is configured to perform rotation control in which the output value is set such that the rotation speed detected by the speed detector becomes equal to a target rotation speed, and to change the output value after the lapse of the initial driving period by changing the target rotation speed.

5. The electric power tool according to claim 1, further comprising a speed selector switch configured to select an operation mode of the electric power tool from among a plurality of operation modes different in a rotation speed of the motor, wherein the control unit is configured to control the output value such that the rotation speed of the motor becomes a rotation speed corresponding to the operation mode selected via the speed selector switch.

6. The electric power tool according to claim 5, wherein the control unit is configured to start driving the motor with the output value corresponding to a rotation speed in a low speed mode, and not to change the output value after the motor is started driven when the operation mode selected is the low speed mode, the low speed mode being a mode in which the motor rotates at a lower speed than a rotation speed for the operation mode not selected.

7. The electric power tool according to claim 1, wherein the control unit is configured to gradually change the output value up to the high speed target value so that a rotation speed of the motor is gradually increased after the lapse of the initial driving period.

8. The electric power tool according to claim 7, wherein the control unit is configured to change the output value at a constant rate of change after the lapse of the initial driving period.

9. The electric power tool according to claim 1, wherein the output value corresponds to a duty ratio of a PWM signal used to drive and control the motor.

10. The electric power tool according to claim 1, wherein the output value corresponds to a conduction angle.

11. The electric power tool according to claim 1, wherein the hitting mechanism comprises:

a hammer configured to rotate by the rotational force generated by the motor;

the anvil being configured to rotate in response to rotation of the hammer; and an attachment portion configured to attach the tool element to the anvil, the hitting mechanism being configured such that, when the torque of the predetermined value or more is applied to the anvil, the hammer is disengaged from the anvil to run idle and hits the anvil in the rotation direction of the tool element.

12. An electric power tool comprising:

a motor configured to generate a rotational force for rotating a tool element attached to the electric power tool;

a hitting mechanism configured to generate a hitting force in a rotation direction of the tool element when a torque of a predetermined value or more is applied to the tool element, and to transmit the hitting force to the tool element;

a hitting detector configured to detect a hit by the hitting mechanism;

a control unit configured to control an output value for driving of the motor, the control unit further configured to set a low speed target value to the output value during an initial driving period, and to set a high speed target value to the output value when the initial driving period elapses, the initial driving period being a period, after the motor is started driven, from when the hit is detected by the hitting detector until a predetermined first time period elapses; and a speed selector switch configured to select an operation mode of the electric power tool from among a plurality of operation modes different in a rotation speed of the motor, wherein the control unit is configured to control the output value such that the rotation speed of the motor becomes a rotation speed corresponding to the operation mode selected via the speed selector switch, and wherein the control unit is configured to gradually change the output value up to the high speed value at a different rate of change for each of the plurality of operation modes, so that the rotation speed of the motor is gradually increased after the lapse of the initial driving period.

13. The electric power tool according to claim 12, wherein the control unit is configured to set the output value when the selected operation mode is a low speed mode such that a rate of change of the output value upon gradually changing the output value up to the high speed value becomes more than a rate of change of the output value at the time when the selected operation mode is a high speed mode, the low speed mode being a mode in which the motor rotates at a lower speed than a rotation speed for the operation mode not selected, and the high speed mode being a mode in which the motor rotates at a higher speed than a rotation speed for the operation mode not selected.

14. The electric power tool according to claim 12, wherein the control unit is configured to set the output value when the selected operation mode is a low speed mode such that a rate of change of the output value upon gradually changing the output value up to the high speed target value becomes less than a rate of change of the output value at the time when the selected operation mode is a high speed mode, the low speed mode being a mode in which the motor rotates at a lower speed than a rotation speed for the operation mode not selected, and the high speed mode being a mode in which the motor rotates at a higher speed than a rotation speed for the operation mode not selected.

15. An electric power tool comprising:

a motor configured to generate a rotational force for rotating a tool element attached to the electric power tool;

a hitting mechanism configured to generate a hitting force in a rotation direction of the tool element when a torque of a predetermined value or more is applied to the tool element, and to transmit the hitting force to the tool element;

a hitting detector configured to detect a hit by the hitting mechanism;

a control unit configured to control an output value for driving of the motor, the control unit further configured to set a low speed target value to the output value during an initial driving period, and to set a high speed target value to the output value when the initial driving period elapses, the initial driving period being a period, after the motor is started driven, from when the hit is detected by the hitting detector until a predetermined first time period elapses, wherein the control unit is configured to gradually change the output value up to the high speed target value so that a rotation speed of the motor is gradually increased after the lapse of the initial driving period, wherein the control unit is configured to change the output value at a constant rate of change after the lapse of the initial driving period, and wherein the control unit is configured to change the output value after the lapse of the initial driving period such that the rate of change of the output value is less than an initial rate of change of the output value at a time of increasing the rotation speed of the motor when the motor is started driven.

16. An electric power tool comprising:

a motor configured to generate a rotational force for rotating a tool element attached to the electric power tool;

a hitting mechanism configured to generate a hitting force in a rotation direction of the tool element when a torque of a predetermined value or more is applied to the tool element, and to transmit the hitting force to the tool element;

a hitting detector configured to detect a hit by the hitting mechanism; and a control unit configured to control an output value for driving of the motor, the control unit further configured to set a low speed target value to the output value during an initial driving period, and to set a high speed target value to the output value when the initial driving period elapses, the initial driving period being a period, after the motor is started driven, from when the hit is detected by the hitting detector until a predetermined first time period elapses, wherein the control unit is configured to gradually change the output value up to the high speed target value so that a rotation speed of the motor is gradually increased after the lapse of the initial driving period, and wherein the control unit is configured to change the output value after the lapse of the initial driving period such that a rate of change of the output value is gradually increased in accordance with an elapsed time.

17. The electric power tool according to claim 16, wherein the control unit is configured to change the output value up to the high speed target value such that the rate of change of the output value after the lapse of the initial driving period is less than an initial rate of change in a predetermined second period after the lapse of the initial driving period, and becomes more than the initial rate of change over time after the lapse of the second period, the initial rate of change being a rate of change of the output value at the time of increasing the rotation speed of the motor when the motor is started driven.

* * * * *